US012290163B2

(12) United States Patent
Wang

(10) Patent No.: US 12,290,163 B2
(45) Date of Patent: May 6, 2025

(54) WEARABLE, CONFIGURABLE PERSONAL ELECTRONIC DEVICE

(71) Applicant: Universal Electronics Inc., Scottsdale, AZ (US)

(72) Inventor: Eric Wang, Tainan (TW)

(73) Assignee: Universal Electronics Inc., Scottsdale, AZ (US)

( * ) Notice: Subject to any disclaimer, the term of this patent is extended or adjusted under 35 U.S.C. 154(b) by 231 days.

(21) Appl. No.: 17/952,450

(22) Filed: Sep. 26, 2022

(65) Prior Publication Data

US 2024/0099448 A1 Mar. 28, 2024

(51) Int. Cl.
*A45F 5/02* (2006.01)
*A45F 5/00* (2006.01)

(52) U.S. Cl.
CPC ..... *A45F 5/02* (2013.01); *A45F 2005/006* (2013.01); *A45F 2005/008* (2013.01)

(58) Field of Classification Search
CPC ..... A45F 2005/006; A45F 2005/008; A45F 2200/0516; A45F 5/00; A45F 5/02; Y10S 224/93; A44C 5/14; A44C 5/2085; A44C 5/147; A44B 11/2596; A44B 11/263
See application file for complete search history.

(56) References Cited

U.S. PATENT DOCUMENTS

| | | | | |
|---|---|---|---|---|
| 5,471,716 | A * | 12/1995 | Takahashi | A44B 11/263 24/615 |
| 5,898,647 | A * | 4/1999 | Goradesky | G04B 37/1433 368/86 |
| 7,882,601 | B2 * | 2/2011 | Nguyen | A44B 11/2596 24/615 |
| D724,103 | S | 3/2015 | Akana et al. | |
| 9,078,498 | B2 * | 7/2015 | Richardson | A45F 5/02 |
| 10,085,523 | B2 | 10/2018 | Perkins et al. | |
| 10,182,623 | B2 * | 1/2019 | Perkins | G04B 37/1486 |
| 10,264,857 | B2 | 4/2019 | Perkins et al. | |
| 10,285,475 | B1 * | 5/2019 | Tully, Jr. | A44C 5/147 |
| D922,894 | S | 6/2021 | Akana et al. | |
| 11,026,484 | B2 | 6/2021 | Perkins et al. | |
| 2007/0235493 | A1 * | 10/2007 | Fortson | H04B 1/3888 224/257 |
| 2016/0040698 | A1 * | 2/2016 | Perkins | A44B 17/0011 24/664 |
| 2016/0088923 | A1 * | 3/2016 | Köeck | A45F 5/00 24/3.1 |

* cited by examiner

*Primary Examiner* — Adam J Waggenspack
(74) *Attorney, Agent, or Firm* — Greenberg Traurig, LLP

(57) ABSTRACT

A configurable, wearable electronic device is shown and described. The configurable, wearable electronic device may be configured to be worn around a user's neck via a lanyard and a special longitudinal insert of the configurable having an attached tether, worn on a user's clothing via a conforming cradle assembly or worn on a user's wrist by removing one or more longitudinal inserts of the configurable, wearable electronic device and connecting a wrist strap having two longitudinal inserts that fit into a respective channel of the configurable, wearable electronic device.

3 Claims, 35 Drawing Sheets

WEARABLE, CONFIGURABLE PERSONAL ELECTRONIC DEVICE

BACKGROUND

I. Field of Use

The present application relates to the field of consumer electronics. More specifically, the present application relates to an innovative, wearable, configurable, personal electronic device.

II. Description of the Related Art

Personal, wearable electronic devices were introduced to consumers in the early 21$^{st}$ century, primarily in the field of health-monitoring. Products such as heartbeat monitors, step-counters and fall detectors became very popular. Since then, this market has exploded to include smart watches (such as the ubiquitous iWatch manufactured by Apple Inc. of Cupertino, California), smart rings, smart eyeglasses, smart jewelry, smart garments, etc.

Generally, each type of personal, wearable electronic devices is configured to be worn by a user in a single, particular way. For example, smart watches are designed to be used with a watchband and worn around a user's wrist. Various health monitors are designed to be worn on a particular body part, such as on a user's wrist, hung around a user's neck via a lanyard, embedded into clothing, on a user's for head, etc. Typically, there is no way to wear a particular personal, wearable electronic device in a different manner than intended by a manufacturer. In other words, a personal, wearable electronic device is typically worn in only one particular way.

In some cases, it would be desirable to configure a wearable, personal electronic device to be worn in a variety of ways.

SUMMARY

The embodiments described herein relate to a configurable, wearable, personal electronic device. In one embodiment, a configurable, wearable personal electronic device comprises a housing, a top channel formed through a top portion of the housing extending from a first side of the housing to an opposing second side of the housing, a bottom channel formed through a bottom portion of the housing extending from the first side of the housing to the opposing second side of the housing, a top longitudinal insert having a cross-section substantially matching a cross-section of the top channel for insertion into and removal from the top channel, and a bottom longitudinal insert having a cross-section substantially matching a cross-section of the bottom channel for insertion into and removal from the bottom channel.

In another embodiment, a longitudinal insert for configuring a wearable, personal electronic device for wear around a user's neck is described, comprising a longitudinal body comprising an inner surface, and outer surface and two end surfaces, a tether extending from a longitudinal axis of the longitudinal body, the tether for receiving a lanyard, and securing means for releasably securing the longitudinal insert inside a longitudinal channel of the wearable, personal electronic device.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, and wherein.

DETAILED DESCRIPTION

The present disclosure describes a wearable, configurable, personal electronic device. The wearable, configurable, personal electronic device may be configured to be worn in one of at least three different ways: around a user's neck, clipped to a user's belt, pants, or an inanimate object (such as a desk, a dashboard, a table, etc.), or worn on a user's wrist with the aid of a common watch band. It should be understood that while described herein as a wireless panic button, the wearable, configurable, personal electronic device could alternatively comprise another wearable, configurable, personal electronic device, such as a smartwatch, fall detector, fitness tracker, health monitor (such as a glucose monitor), etc.

Figure 1:
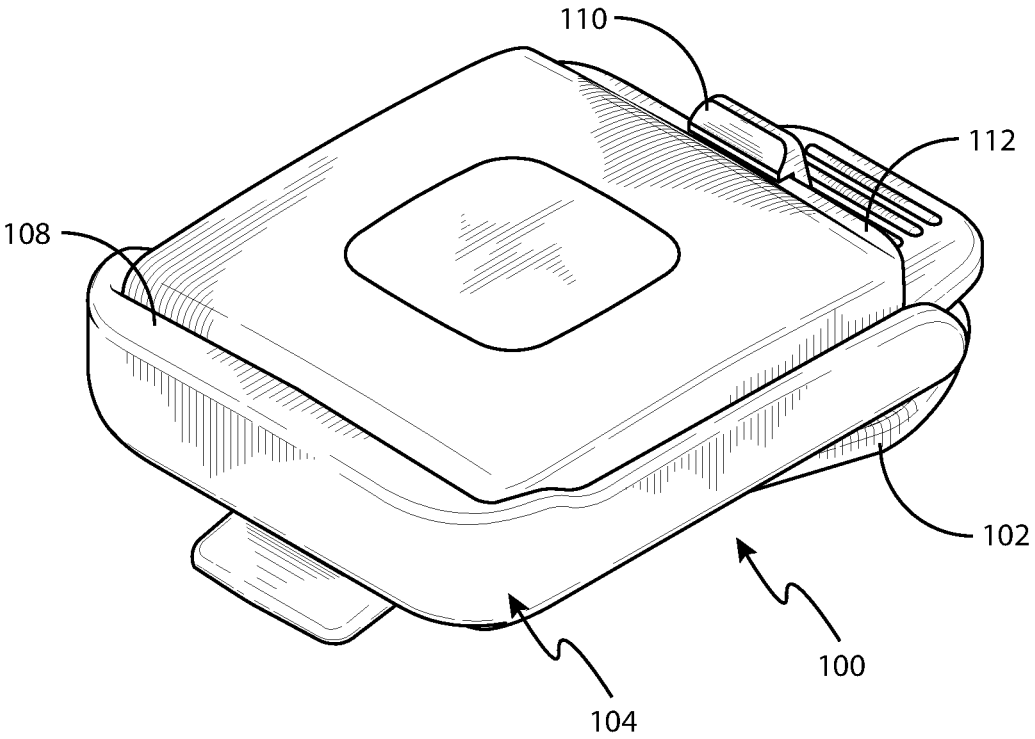
FIG. 1 is a perspective view of one embodiment of a wearable, configurable, personal electronic device secured into a cradle.

FIG. 1 is a perspective view of one embodiment of a wearable, configurable, personal electronic device 100 held by cradle 104. In this configuration, device 100 is configured to be worn by a user, such as on a user's belt, pants, shirt, etc., or mounted to an inanimate object such as a desk, table, dashboard, etc. Cradle 104 comprises clip 102, for securing device 100 to a user or to an inanimate object. Cradle 104 further comprises a specially-formed bottom lip 108 extending generally across a width of cradle 104, forming a concave recess substantially matching the size and shape of a bottom ledge (not shown this view) of device 100, the bottom ledge generally extending a width of device 100. When inserting device 100 into cradle 104, the bottom ledge is first inserted into the concave recess formed by bottom lip 108, and then a top ledge 112 of device 100 is pushed down towards a front surface of cradle 104 and, in the process, forcing a latch 110 away from device 100 which then springs back into place and mechanically securing top beveled lip 112 as device 100 is fully inserted into cradle 104. Alternatively, the latch 110 may be "bent" away from device 100 while inserting device 100 and then released, with latch 110 then engaging top ledge 112.

Clip 102 may be formed as part of cradle 104 or it may be a separate part, mechanically coupled to a back side of cradle 104. The use of bottom lip 108 forming the concave recess, latch 110 and the top and bottom ledges of device 100, in combination, form a unique means to removably secure device 100 to cradle 104 while achieving a streamlined, pleasing appearance of device 100 to users.

In the embodiment shown in FIG. 1, device 100 comprises a panic button used to wirelessly summon help in the event of a fall, an adverse medical emergency, a threat to personal safety or for some other reason. It should be understood, however, that device 100 may alternatively comprise other types of personal electronic devices, such as a smartwatch, a health monitor, a fitness monitor, or some other small, portable electronic device. The term "personal" generally refers to an electronic device that is typically worn or used by an owner of the electronic device, such as the types of electronic devices just mentioned. Such devices are generally not shared amongst different users. Device 100, as shown in FIG. 1, is approximately 1½ inches wide, 1½ inches long, and ½ inch thick although in other embodiments, device 100 could comprise different measurements in width, length and/or thickness.

Figure 2:
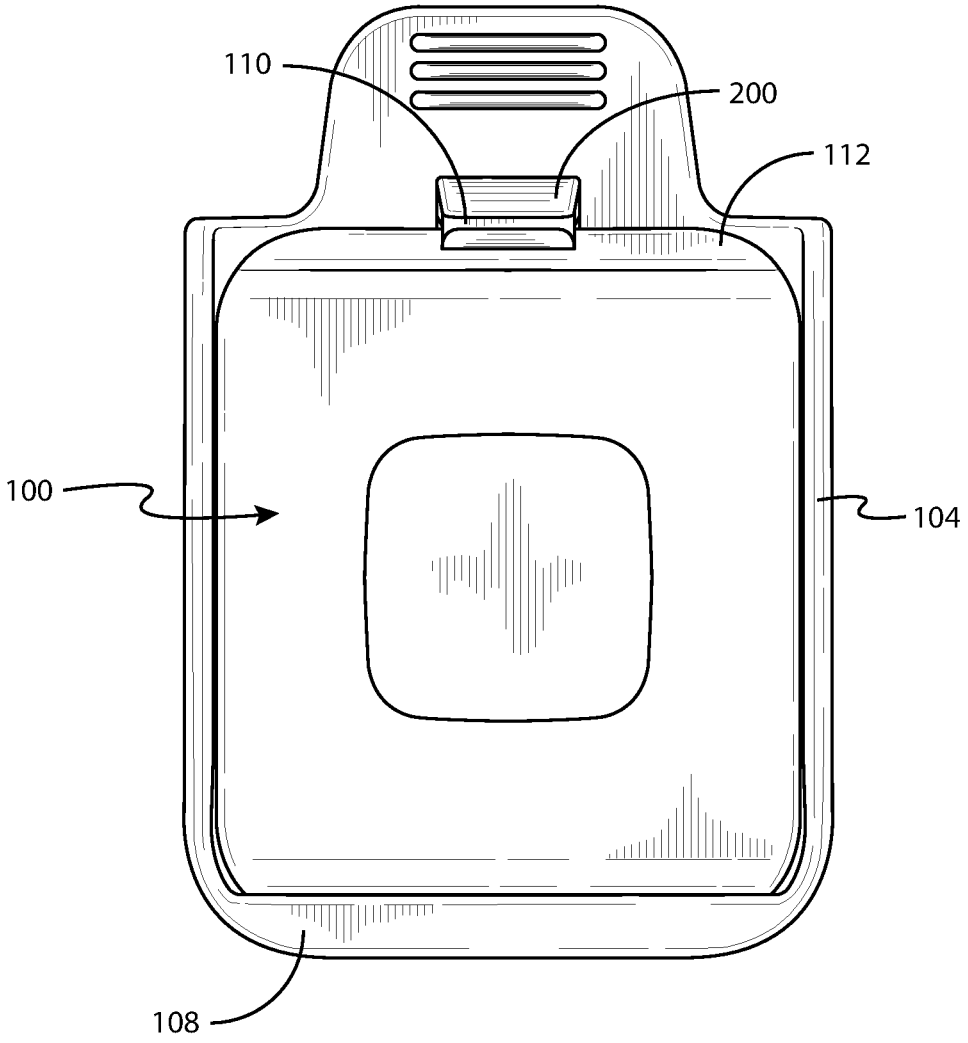
FIG. 2 is a front, plan view of the wearable, configurable, personal electronic device and cradle as shown in FIG. 1.

FIG. 2 is a front, plan view of device 100 as shown in FIG. 1, offering a clearer view of how device 100 is held into cradle 104. The bottom ledge of device 100 (hidden from view by bottom lip 108) is captured by bottom lip 108 of cradle 104, while latch 110 of vertical post 200 captures top ledge 112 of device 100. Vertical post 200 extends substantially perpendicularly from a front surface of cradle 104, supporting latch 110 at a distal end.

Figure 3:
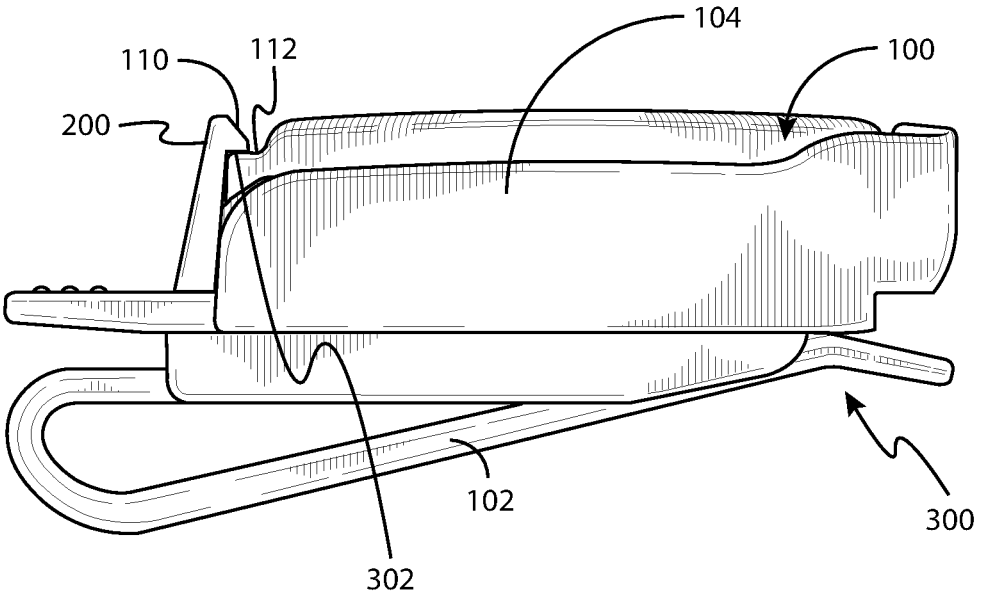
FIG. 3 is a left, side view of the wearable, configurable, personal electronic device and cradle as shown in FIG. 1.

FIG. 3 is a left, side view of device 100 as shown in FIG. 1, better illustrating clip 102, vertical post 200, and latch 110. Clip 102 is shown in a "closed" position, where end portion 300 of clip 102 rests against a back surface of cradle 104. Clip 102 is manufactured from a deformed or material, such as plastic, such that end portion 300 may be lifted away from the back surface of cradle 104, thereby allowing device 100 to be clipped onto a user's belt, pants, shirt, table, desk, etc. a spring force is developed when end portion 300 is positioned away from the back surface of clip 102, thus securing vice 100 in place.

Vertical post 200, along with latch 110, secures device 100 within cradle 104 via mechanical interference between a bottom surface 302 of latch 110 and top ledge 112.

Figure 4:
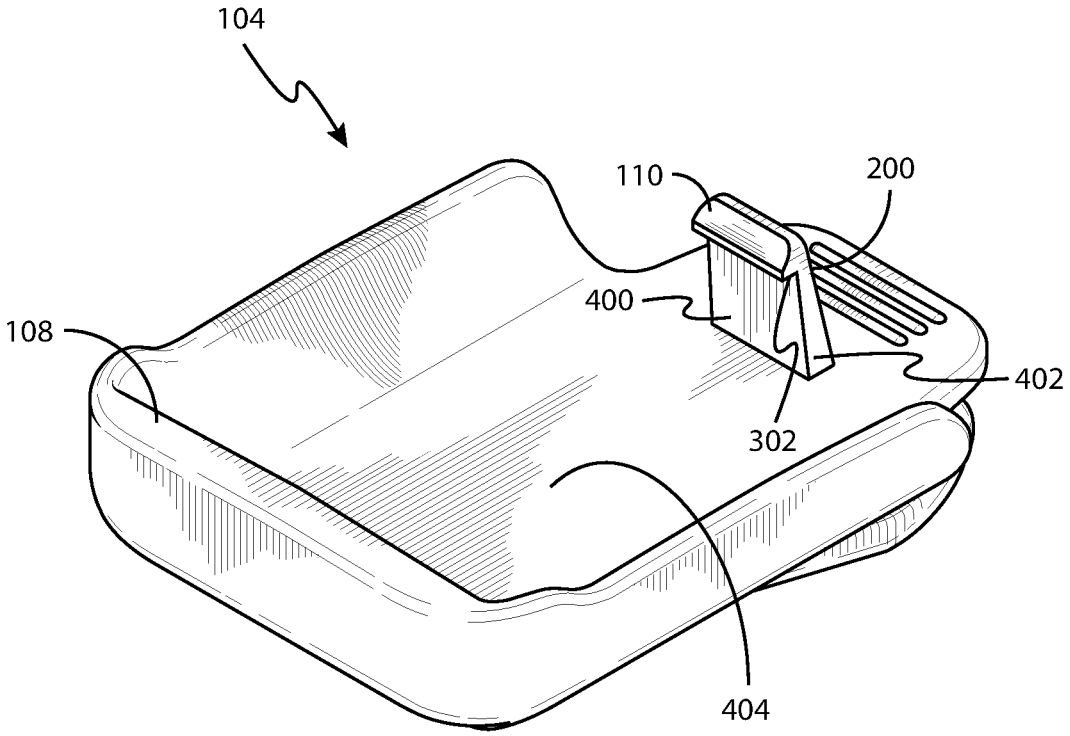
FIG. 4 is a perspective view of a cradle of the wearable, configurable, personal electronic device shown in FIG. 1.

FIG. 4 is a perspective view of cradle 104, clearly illustrating vertical post 200 and latch 110. Also shown in better detail is a front surface 400 of vertical post 200 and a rear surface 402 of vertical post 200. In the embodiment shown in FIG. 4, front surface 400 extends perpendicularly to front surface 404 of cradle 104, while rear surface 402 extends at an angle with respect to front surface 404. In other embodiments, the shape of vertical post 200 may take other forms, such as a rectangular cuboid or prism, where both front surface 400 and rear surface 402 each extend perpendicularly from front surface 404. As another example, front surface 400 may extend at an angle to front surface 400, while rear surface 402 may extend perpendicularly from surface 400.

Figure 5A:
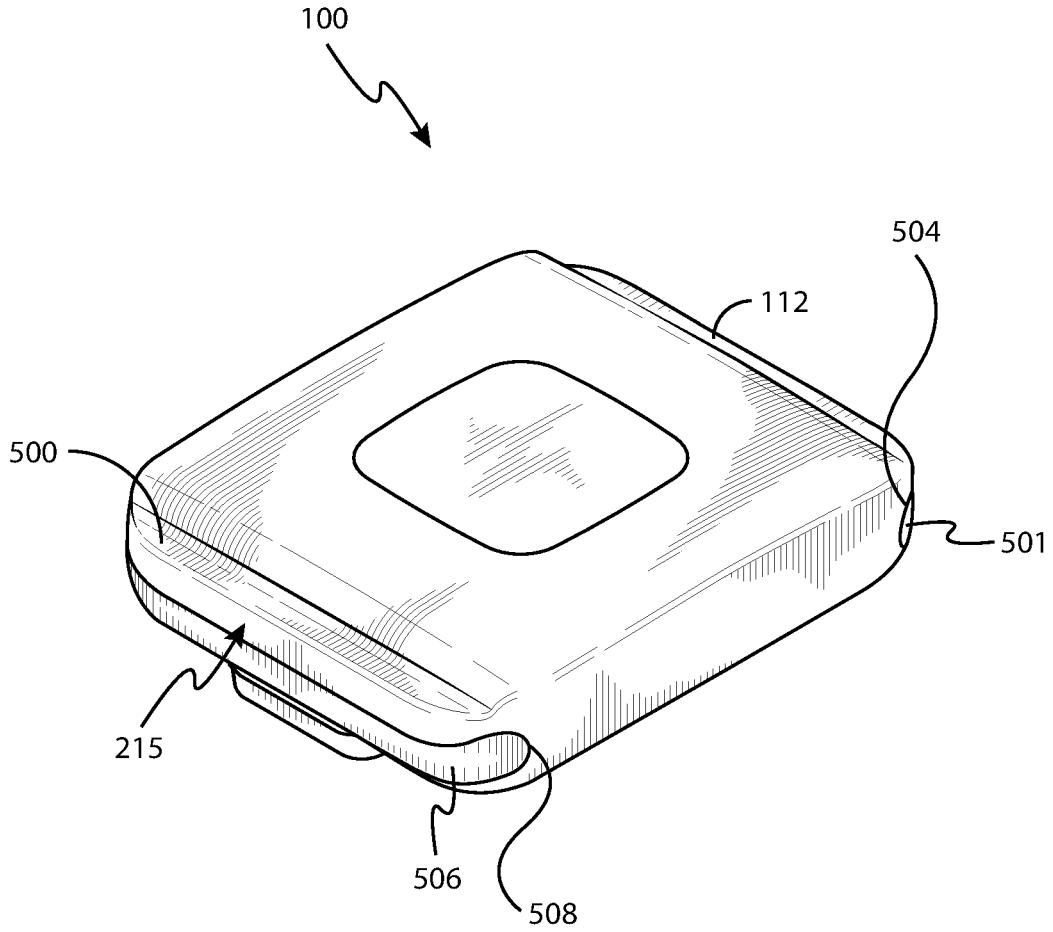
FIG. 5A is a perspective view of the wearable, configurable, personal electronic device as shown in FIG. 1.

FIG. 5A is a perspective view of device 100 as shown in FIG. 1, configured for placement within cradle 104, i.e., for wearing device 100 on a user's belt, waistline or inanimate object. In this view, a housing 514 comprises bottom ledge 500 as shown, as well as a top ledge 112, a top longitudinal insert 501 inserted into a top channel 504 and a bottom longitudinal insert 506 inserted into a bottom channel 508. The top and bottom channels will be shown and described in more detail later herein, as only their outline is visible in FIG. 5A, obscured with the longitudinal inserts installed.

Both of the longitudinal inserts are held in place inside their respective channels by a latch and recess combination, described in detail later herein. The latch and recess combination retain each longitudinal insert within their respective channels and make it easy to remove each longitudinal insert from its respective channel. In one embodiment, each of the longitudinal inserts comprises an outer, rounded surface, sized and shaped to conform to a rounded surface of each end of housing 514, i.e., a surface of bottom portion 512 and a top portion (shown more clearly later herein) of housing 514 in order to present a smooth and uninterrupted surface, as shown. In the embodiment shown in FIG. 5A, top longitudinal insert 501 and bottom longitudinal insert 506 are identical or substantially so.

Figure 5B:
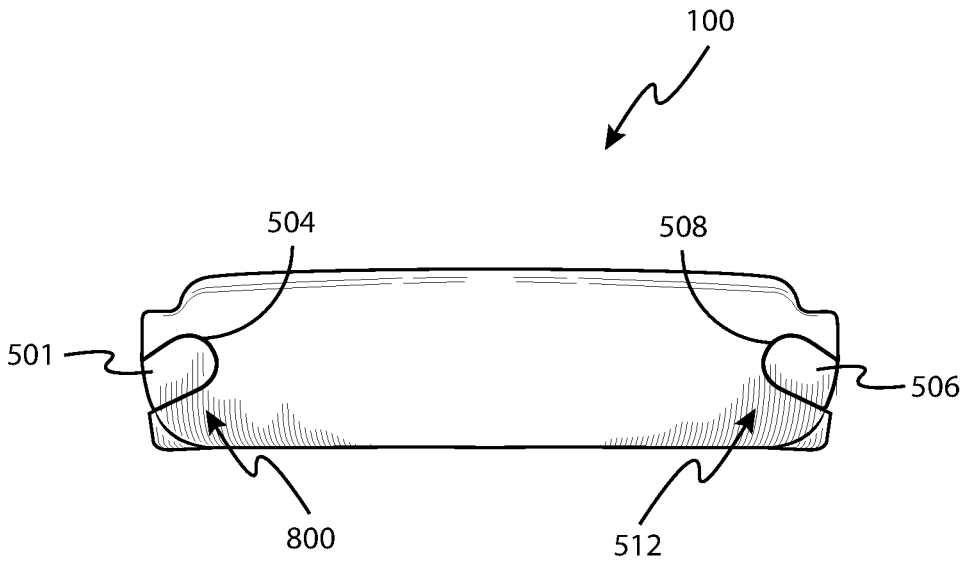
FIG. 5B is a side, plan view of the wearable, configurable, personal electronic device as shown in FIG. 5A.

FIG. 5B is a side, plan view of the wearable, configurable, personal electronic device as shown in FIG. 5A, highlighting top longitudinal insert 501 and bottom longitudinal insert 506, comprising identical or substantially identical inserts. Also shown is how top longitudinal insert 501 substantially conforms to top portion 800 and bottom longitudinal insert 506 substantially conforms to bottom portion 512 such that top portion 800 and bottom portion 512 are substantially uninterrupted, except for a lines formed by the boundary between top longitudinal insert 501 and channel 504 and between bottom longitudinal insert 506 and channel 508.

Figure 5C:
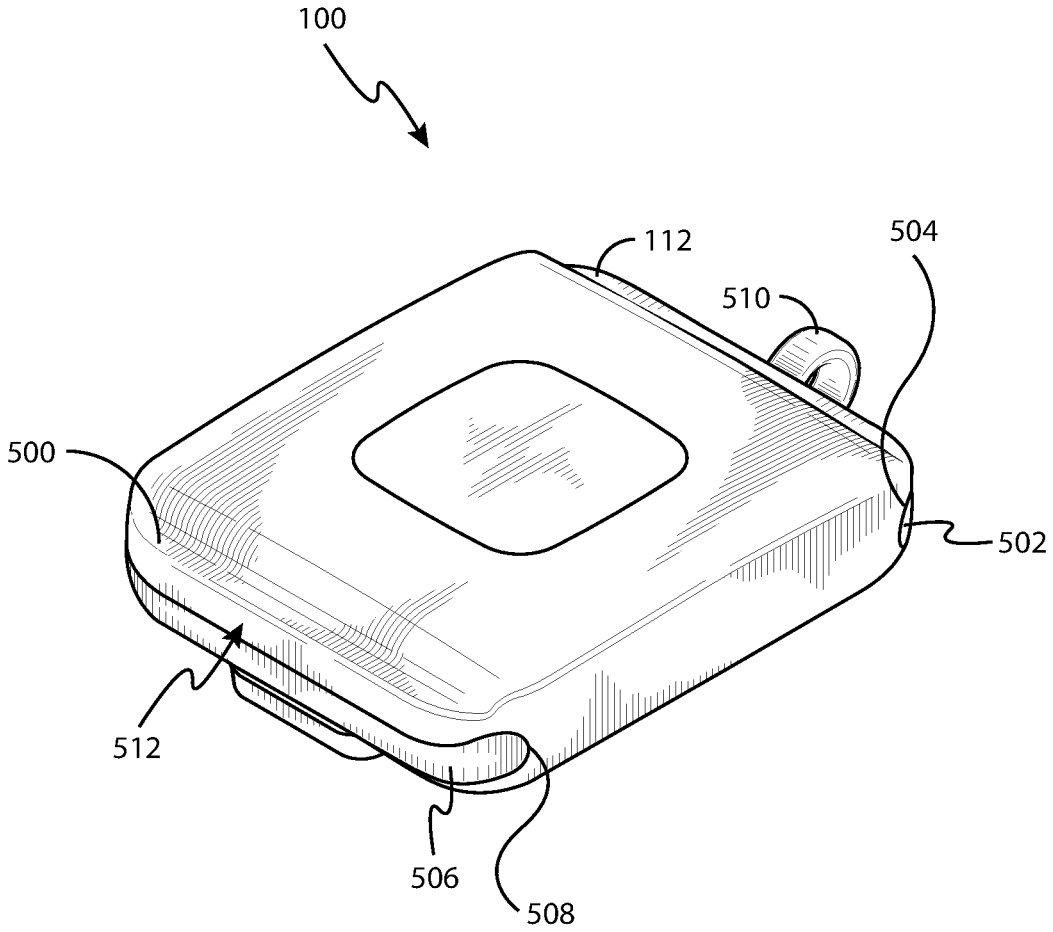
FIG. 5C is a perspective view of another embodiment of the wearable, configurable, personal electronic device shown in FIG. 5A.

FIG. 5C is a perspective view of device 100. In this embodiment, device 100 is configured for wear around a user's neck via a lanyard (not shown). In this embodiment, device 100 is identical to the configuration shown in FIG. 5A, except that top longitudinal insert 501 is replaced by top longitudinal insert 502, comprising tether 510.

Figure 6:
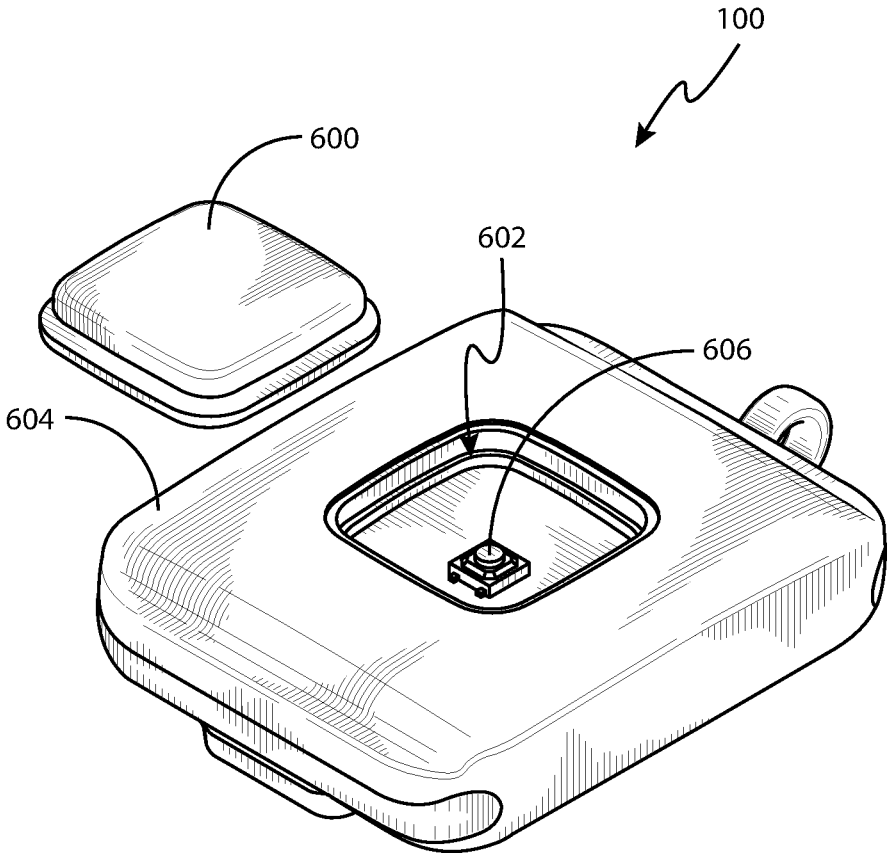
FIG. 6 is a partial, exploded view of the wearable, configurable, personal electronic device as shown in FIG. 5C.

FIG. 6 is a partial, exploded view of device 100 as shown in FIG. 5C. In this embodiment, housing 514 comprises a depressible cover 600 that fits into a cavity 602 formed into a front surface 604 of device 100. A micro pushbutton 606 is located inside cavity 602, as shown, which acts as a user input device for activating device 100 in order to, generally, transmit some sort of message to a remote location. In operation, cover 600 is placed into cavity 602 and secured by well-known mechanical means and located just above micro pushbutton 606. When a user wishes to activate device 100, the user presses depressible cover 600 and depressible cover 600 deforms until it depresses micro pushbutton 606. Of course, in other embodiments, cover 600 and pushbutton 606 are not used, and other mechanisms, displays or some other user input and/or output devices are located on front surface 604 of housing 514.

Figure 7:
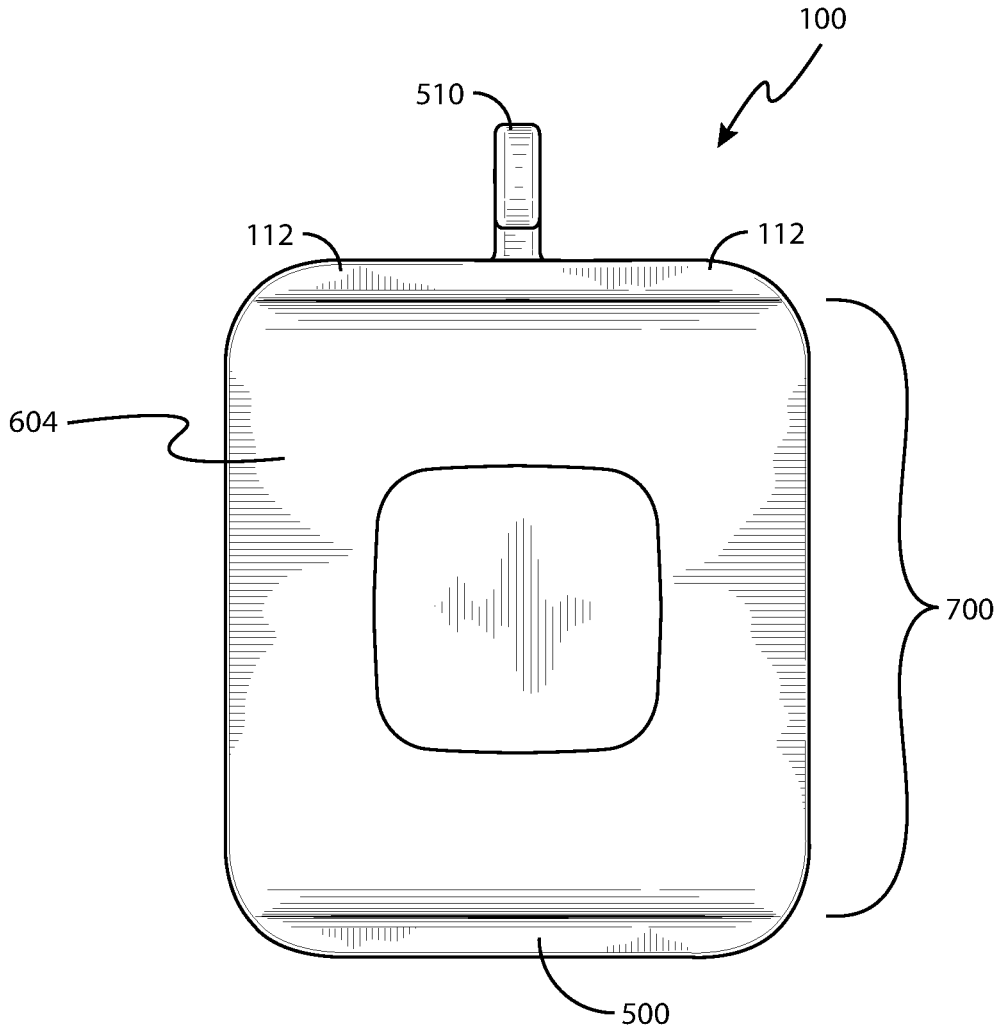
FIG. 7 is a top, plan view of the wearable, configurable, personal electronic device shown in FIG. 5C.

FIG. 7 is a top, plan view of device 100, clearly showing bottom ledge 500, top ledge 112, and tether 510. Each of the ledges extend from a main portion 700 of housing 514 about 1/16 of an inch in this embodiment, although in embodiments, the dimensions of the ledges may be greater or less than 1/16 of an inch. Tether 510 is shown extending approximately 1/4 inch away from an edge of top ledge 112 of housing 514.

Figure 8:
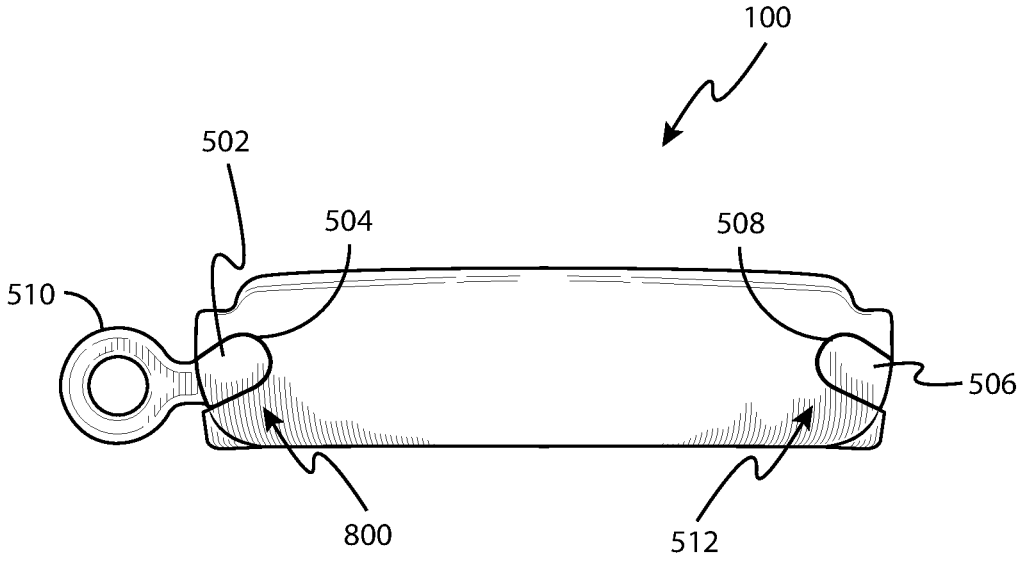
FIG. 8 is a left, plan view of the wearable, configurable, personal electronic device shown in FIG. 5C.

FIG. 8 is a left, plan view of device 100 better illustrating the longitudinal inserts and tether 510. As shown, top longitudinal insert 502 is flush with a surface of top portion 800 while bottom longitudinal insert 506 is flush with a surface of bottom portion 512. In the embodiment shown in FIG. 8, tether 510 is shown as a circular eyelet but in other embodiments, the eyelet need not be circular, but could comprise one of any number of different shapes. In other embodiments, the eyelet need not be complete, i.e., a gap may exist in the eyelet in order to slide the eyelet onto a lanyard. Again, top channel 504 and bottom channel 508 are obscured by the installed longitudinal inserts, and so only their cross-sectional outlines can be seen in FIG. 8.

Figure 9:
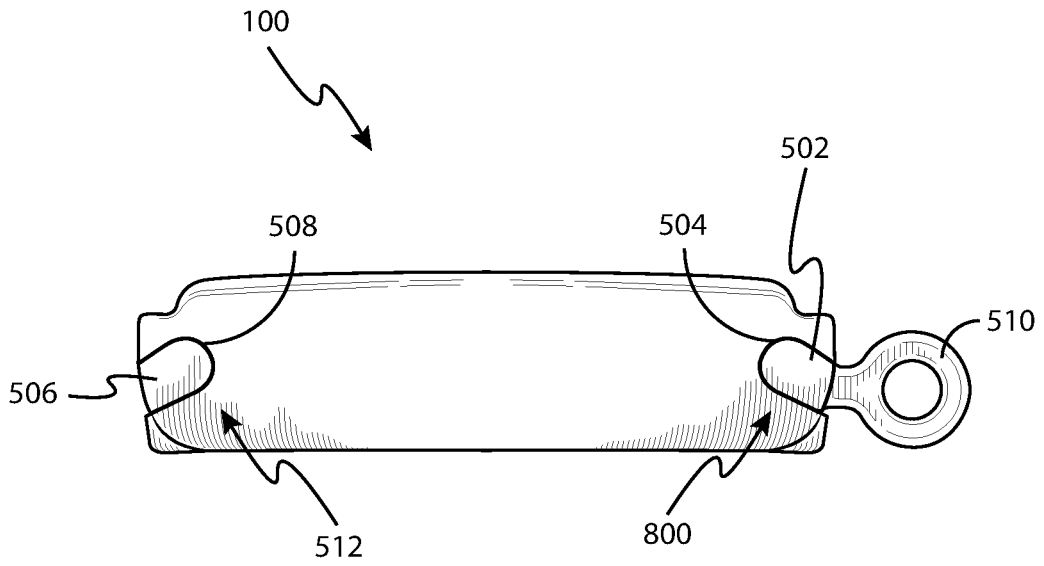
FIG. 9 is a right, plan view of the wearable, configurable, personal electronic device shown in FIG. 5C.

FIG. 9 is a right, plan view of device 100, illustrating device 100 from an opposing side as the view shown in FIG. 8. FIG. 9 illustrates that device 100, including both longitudinal inserts and both channels, are symmetrical, although that not need be the case in other embodiments.

Figure 10:
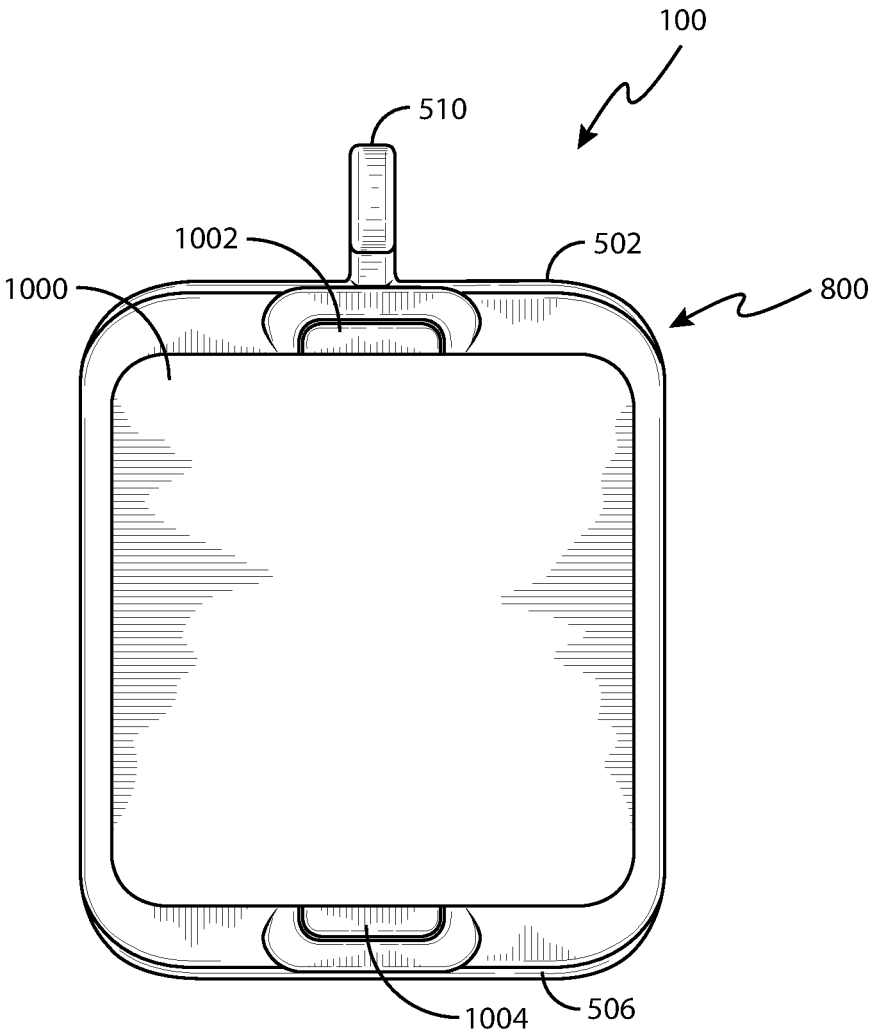
FIG. 10 is a back, plan view of the wearable, configurable, personal electronic device shown in FIG. 5C.

FIG. 10 is a back, plan view of device 100, illustrating a back surface 1000, a top releasing insert 1002 and a bottom releasing insert 1004. Also shown is a back view of tether 510, a portion of top longitudinal insert 502 and a portion of bottom longitudinal insert 506. Back surface 1000 may be a separate component that is mechanically attached to the rest of housing 514 in order, for example, to remove back service 1000 and replace a battery located within device 100. In other embodiments, back surface 1000 is an integral part of housing 514 and is not removable.

The releasing inserts are each seated within a respective opening, channel or "passage" formed through the back, top and bottom portions, respectively, of housing 514 and into top channel 504 and bottom channel 508, respectively. The passages are shown and described in greater detail later herein. Each of the releasing inserts are movable within the passage, to engage a respective flexible tab of each longitudinal insert, yet retained mechanically so that they do not fall out of the passages.

Figure 11:
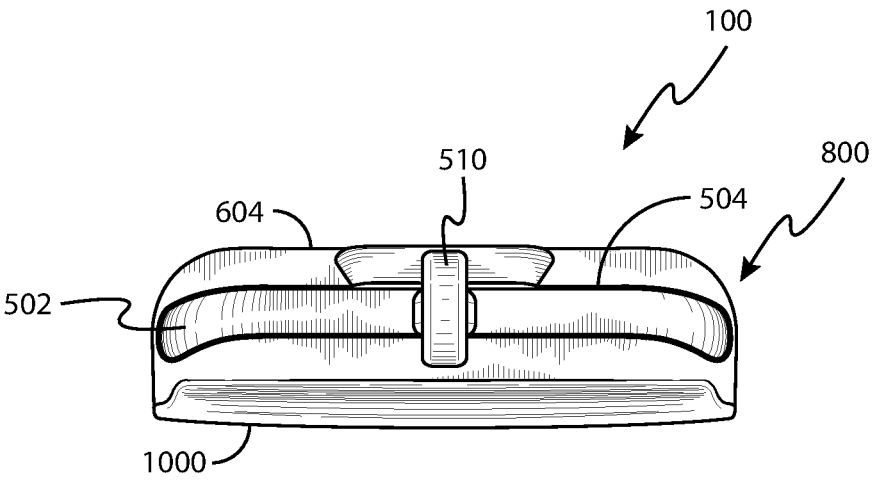
FIG. 11 is a top, plan view of the wearable, configurable, personal electronic device shown in FIG. 5C.

FIG. 11 is a top, plan view of device 100, illustrating top longitudinal insert 502 inserted into top channel 504. Further, tether 510 is shown relative to a thickness of device 100 and a width of top longitudinal insert 502. Top longitudinal insert 502 is inserted into top channel 504 laterally, as shown in FIG. 11, either from the left and/or from the right. Top longitudinal insert 502 is held in place by a combination of a flexible tab and recess formed into top longitudinal insert 502 (not shown in this view) and a reciprocal passage formed through top portion 800 (also not shown in this view), as will be explained in greater detail later herein.

Figure 12:
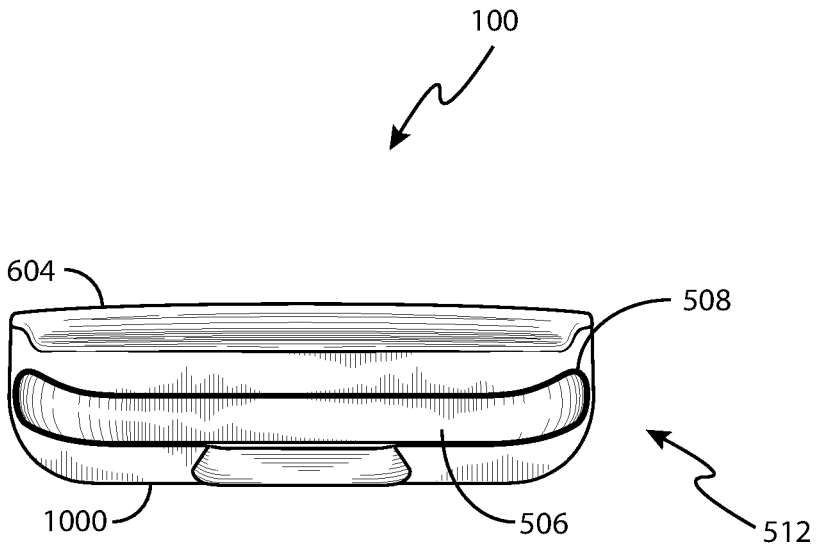
FIG. 12 is a bottom, plan view of the wearable, configurable, personal electronic device shown in FIG. 5C.

FIG. 12 is a bottom, plan view of device 100, illustrating bottom longitudinal insert 506 inserted into bottom channel 508. Bottom longitudinal insert 506 is inserted into bottom channel 508 laterally, as shown in FIG. 12, either from the left and/or from the right. Bottom longitudinal insert 506 additionally comprises a flexible tab and recess formed into bottom longitudinal insert 506 in combination with a passage formed through bottom portion 512 (neither shown in this view), as will be explained in greater detail later herein.

Figure 13:
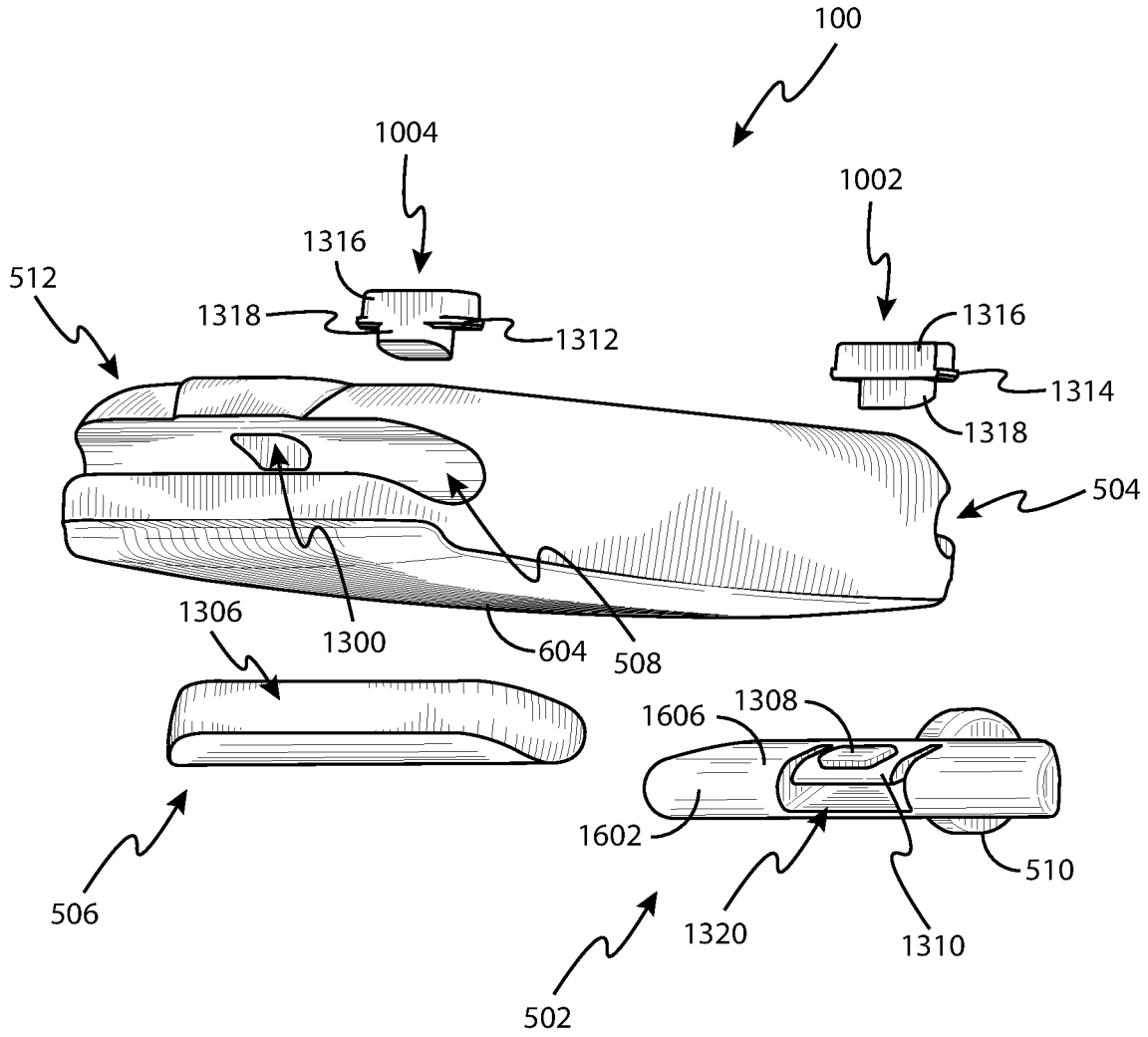
FIG. 13 is an exploded view of the wearable, configurable, personal electronic device shown in FIG. 5C as seen from a bottom perspective.

FIG. 13 is an exploded view of device 100 as seen in a bottom perspective view. In this view, front surface 604 is facing downwards, while back surface 1000 is shown facing upwards, with bottom portion 512 shown nearest to the viewer. This view clearly shows bottom channel 508, bottom passage 1300 and bottom releasing insert 1004. Also shown is top channel 504 (mostly obscured) and top releasing insert 1002.

Bottom channel 508 is clearly shown as a longitudinal channel formed through bottom portion 512, extending a width of housing 514. Bottom longitudinal insert 506 is shown, comprising an outer convex surface 1306 which substantially conforms to a surface of bottom portion 512, such that when inserted into bottom channel 508, a shape of bottom portion 512 is substantially undisturbed. In other words, when bottom longitudinal insert 506 is fully inserted into bottom channel 508, the surface of bottom portion 512 is left largely uninterrupted.

Bottom longitudinal insert 506 slides into bottom channel 508, in some embodiments, from either end. Bottom longitudinal insert 506 is generally prevented from sliding into channel 508 due to mechanical interference between an end of channel 508 and a pad of a flexible tab of bottom longitudinal insert 506. A similar pad 1308 and flexible tab 1310 and a recess 1320 is shown formed in top longitudinal insert 502. Bottom longitudinal insert 506 comprises the same or similar pad, flexible tab and a recess. These components will be shown and described in greater detail later herein. The pad on the flexible tab extends slightly past both a flat surface and a convex surface of bottom longitudinal insert 506, thereby generally preventing insertion of bottom longitudinal insert 506 into channel 508. A similar flat surface 1606 and a similar convex surface 1602 are shown formed in top longitudinal insert 502. Bottom longitudinal insert 506 comprises the same or similar flat surface and convex surface, and will be shown and described in greater detail later herein. In order to insert bottom longitudinal insert 506 into channel 508, the pad and flexible tab of bottom longitudinal insert 506 are pushed into the recess of bottom longitudinal insert 506, thereby eliminating the mechanical interference and allowing bottom longitudinal insert 506 to be inserted into channel 508. When bottom longitudinal insert 506 is fully inserted into channel 508, the pad is forced against a second portion 1318 of bottom releasing insert 1004 inside bottom passage 1300 by a spring force inherent in the flexible tab. At this point, the pad is held inside passage 1300, thereby creating another mechanical interference between the pad and passage 1300, preventing bottom longitudinal insert 506 from easily being removed from channel 508.

During manufacturing, bottom releasing insert 1004 is inserted into passage 1300, and top releasing insert 1002 is inserted into a top passage (not shown in this view). In one embodiment, each of the inserts are pressed into their respective passages and held within each passage by mechanical interference means, as is well-known in the art. For example, each passage may comprise a ridge or deformation that holds a respective insert by interfering with a corresponding deformation or ridge, i.e., ridge 1312 and 1314 of top releasing insert 1002 and bottom releasing insert 1004, respectively, of each insert. In one embodiment, each insert is configured to travel within its respective passage vertically, i.e., in a direction that moves each insert towards or away a respective channel.

In one embodiment, each releasing insert may comprise a first portion 1316 and a second portion 1318. When a releasing insert is installed into a respective passage, first portion 1316 is observable by a user and is generally flush with back surface 1000. When a longitudinal insert is installed completely into a channel, a pad of a flexible tab presses against second portion 1318 caused by the spring force exerted by the flexible tab, forcing a first portion of the releasing insert against an upper mechanical limit in the passage. When it is desired to remove a longitudinal insert, a user may press down on the first portion, forcing the insert upwards, towards front surface 604, with the second portion forcing the pad and flexible tab 1310 into recess 1320 until pad 1308 is flush with a concave surface within a channel. At this point, the longitudinal insert is free to move laterally within the channel and able to be removed due to an elimination of the mechanical interference between the pad and the passage when the pad is pushed flush with the surfaces (both flat and convex) of the longitudinal insert.

Figure 14:
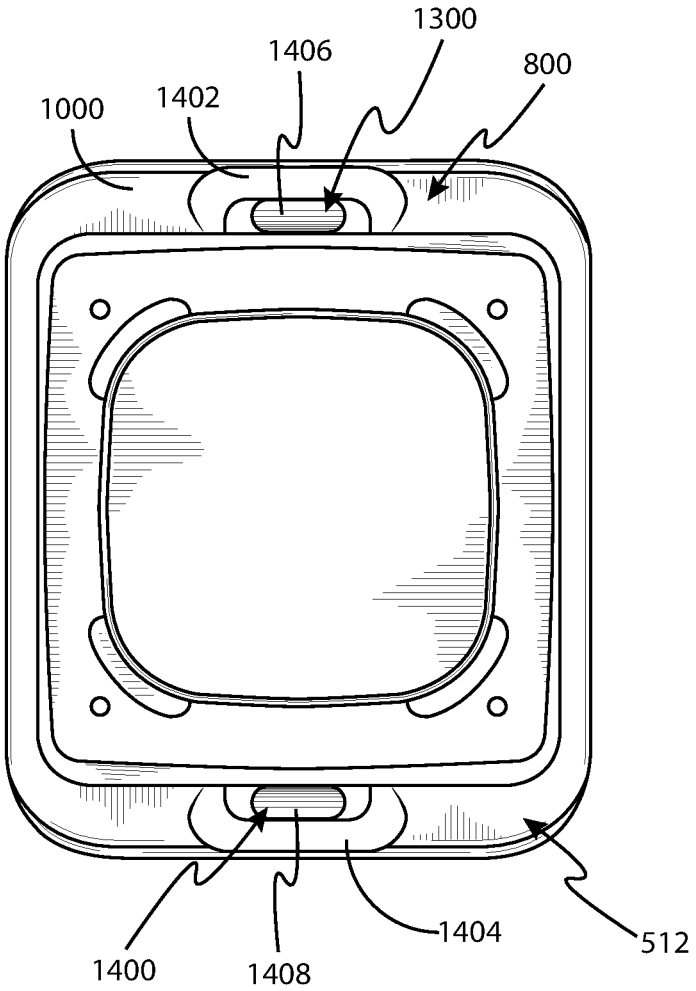
FIG. 14 is a back, plan view of a portion of the wearable, configurable, personal electronic device shown in FIG. 5C, highlighting two passages formed through a rear, top and bottom portions of a housing of the wearable, configurable, personal electronic device, respectively.

FIG. 14 is a back, plan view of device 100, highlighting two passages formed through top portion 800 and bottom portion 512 for placement of top releasing insert 1002 and bottom releasing insert 1004, respectively. Both passages 1300 and 1400 are shown formed as a "flattened" oval, however in other embodiments, each passage need not be of the same shape from the other, and the passages may have other geometric shapes, such as a circle, a rectangle, a square, etc. In the plan view of FIG. 14, a portion of a concave surface 1406 and 1408 of top channel 504 and bottom channel 508, respectively, can be seen. In one embodiment, each of the passages is surrounded by a reinforcing structure, for example, passage 1300 surrounded by reinforcement 1402 and passage 1400 surrounded by reinforcement 1404. The reinforcements may serve to strengthen the area around each passage, and also form a planar base where the passages may each be formed substantially perpendicularly to the planar base. This avoids the problem of the passages, and hence the releasing inserts, having to be formed at an odd angle to match the rounded shape of top portion 800 and bottom portion 512.

Figure 15:
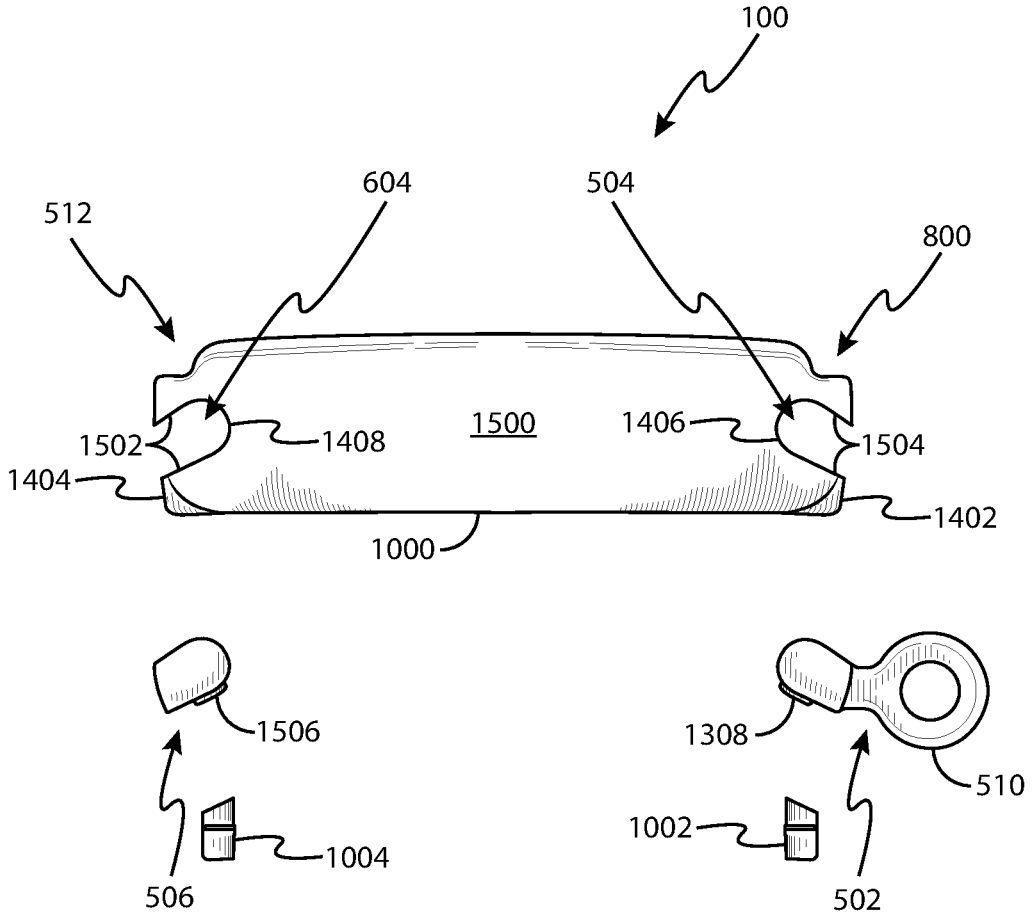
FIG. 15 is a right, exploded view of the wearable, configurable, personal electronic device shown in FIG. 5C.

FIG. 15 is a right, exploded view of device 100, showing right side 1500 of housing 514. This view clearly shows the cross section of each of the channels 508 and 504. In this embodiment, in cross-section, bottom channel 508 comprises concave surface 1408 coupled to two flat surfaces 1502. Top channel 504 comprises concave surface 1406 coupled to two flat services 1504. Of course, the cross-sectional shape of each of the channels could be different in other embodiments, including embodiments where the cross-sectional shape of one or both channels comprise a different geometric arrangement, such as an oblong cross-sectional area, a triangular cross-sectional area, etc. In addition, neither channel may comprise a flat section.

Also particularly shown in FIG. 15 is bottom longitudinal insert 506 and top longitudinal insert 502, each showing pad 1506 and pad 1308 protruding slightly from a flat surface of bottom longitudinal insert 506 and top longitudinal insert 502, respectively. As mentioned previously, pad 1308 is forced into recess 1320 (not shown in this view) in top longitudinal insert 502 as top longitudinal insert 502 is inserted into top channel 504. Similarly, pad 1506 is forced into a recess formed within bottom longitudinal insert 506 (not shown in this view) as bottom longitudinal insert 506 is inserted into bottom channel 508.

Also shown particularly in FIG. 15 is bottom releasing insert 1004 and top releasing insert 1002.

Figure 16:
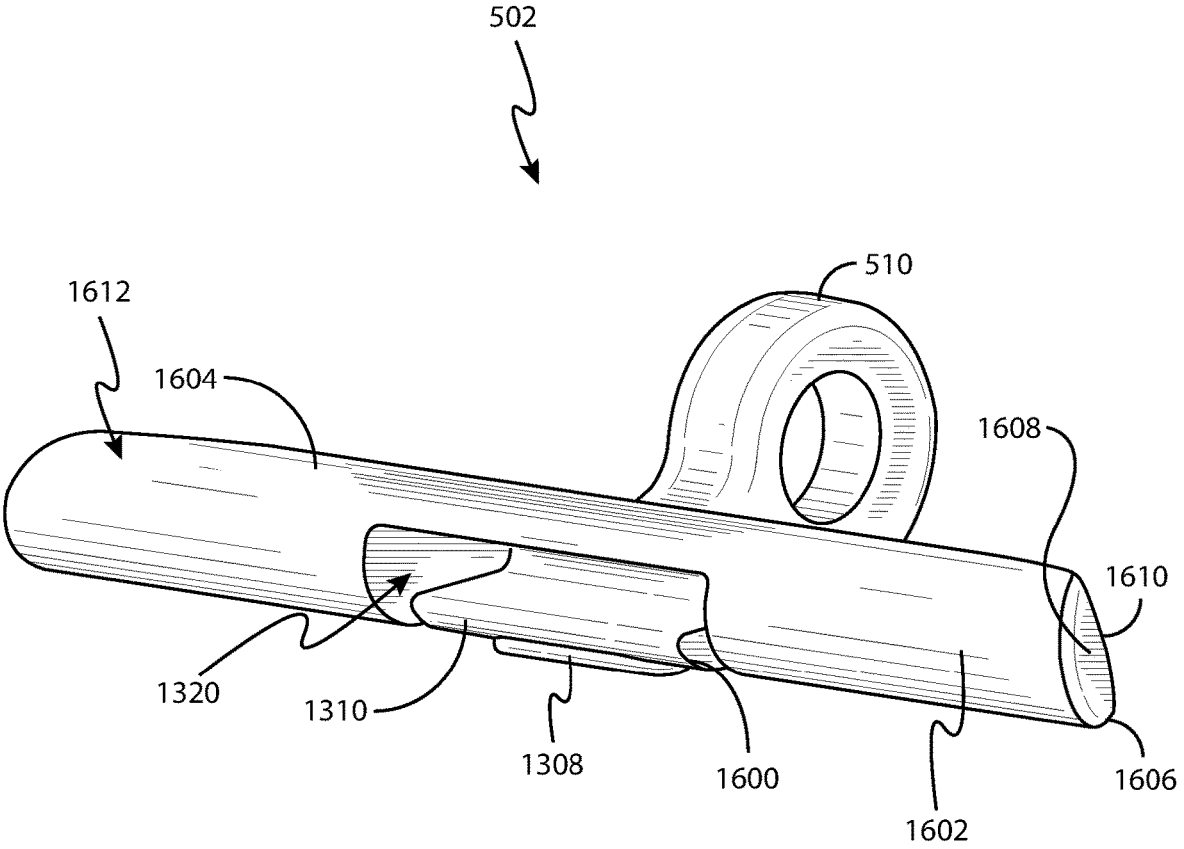
FIG. 16 is a perspective view of a top longitudinal insert of the wearable, configurable, personal electronic device shown in FIG. 5C.

FIG. 16 is a perspective view of top longitudinal insert 502, shown in a "quiescent position", i.e., flexible tab 1310 not pushed into recess 1320. Top longitudinal insert comprises a longitudinal body 1612 comprising an inner surface 1602, an outer surface 1610, two end surfaces 1608 (one end not shown in this view), tether 510 and a securing means 1614 for releasably securing top longitudinal insert inside a longitudinal channel of the wearable, personal electronic device, such as channel 502, the securing means 1614 comprising recess 1320, flexible tab 1310 and pad 1308.

Flexible tab 1310 is shown having a curved surface 1600 that conforms to a convex surface of inner surface 1602 of top longitudinal insert 502 and a flat surface (shown in FIG. 17) that is substantially in line with a bottom surface 1606 when no force is applied to flexible tab 1310. Inner surface 1602 is sized and shaped substantially similarly to concave surface 1406 of top channel 504 and the flat surface of flexible tab substantially matches bottom surface 1606, such that top longitudinal insert 502 may slide into top channel 504 laterally. Inner surface 1602 comprises top surface 1604 and bottom surface 1606, which are both substantially flat in this embodiment, reciprocally mirroring flat surfaces 1504 of top channel 504. Each end 1608 of top longitudinal insert 502 comprises, in this embodiment, a convex surface substantially conforming to a surface of top, right side 1500 and a surface of bottom, left side 516, respectively, of device 100 so that when top longitudinal insert 502 is inserted fully into channel 504, a substantially smooth and uninterrupted surface is achieved. Outer surface 1610 of top longitudinal insert 502 is similarly contoured with a convex surface to match the surface of top portion 800 in this embodiment.

Figure 17:
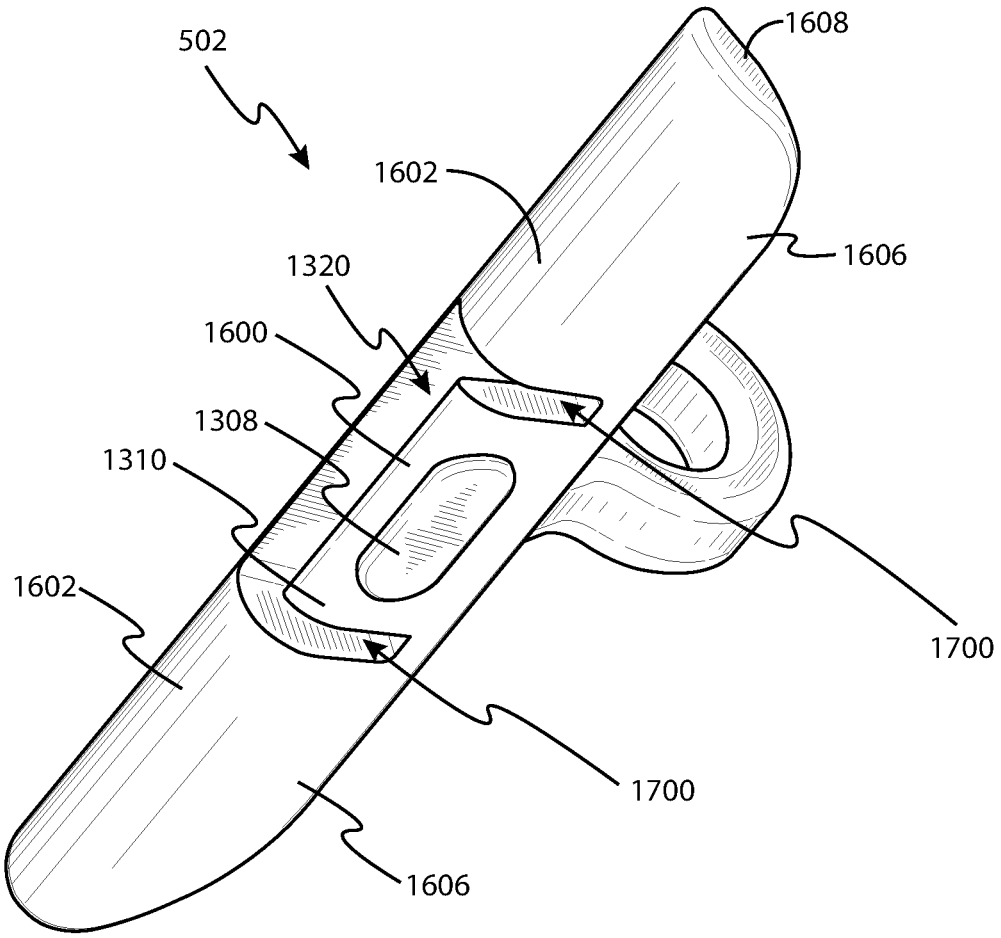
FIG. 17 is another perspective view of the top longitudinal insert as shown in FIG. 16.

FIG. 17 is another perspective view of top longitudinal insert 502 highlighting two notches 1700 formed into inner surface 1602 and bottom surface 1606 of top longitudinal insert 502. The notches 1700 partially form flexible tab 1310 and allow flexible tab 1310 to flex at least inwardly inside recess 1320 while top longitudinal insert 502 is being inserted into top channel 504. Flexible tab 1310 remains generally flush with inner surface 1602 and bottom surface 1606 at rest as shown, and pad 1308 extends past bottom surface 1606.

Figure 18:
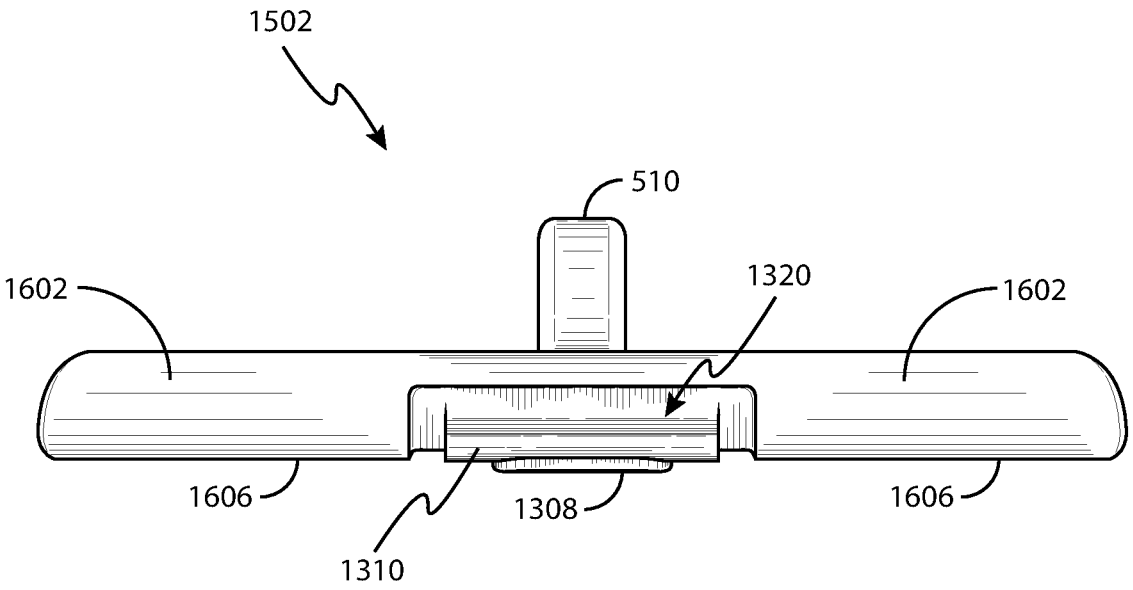
FIG. 18 is a bottom, plan view of the top longitudinal insert as shown in FIG. 16.

FIG. 18 is a bottom, plan view of top longitudinal insert 502, i.e., looking through device 100 from a bottom view, i.e., through bottom longitudinal insert 506 and through device 100. In this view, recess 1320 is clearly shown. Pad 1308 clearly extends past bottom surface 1606 when top longitudinal insert 502 is inserted fully into top channel 504, or when top longitudinal insert 502 is not installed into channel 504. Flexible tab 1310 is shown substantially flush with bottom surface 1606 and inner surface 1602. When inserting top longitudinal insert 502 into channel 504, pad 1308 and flexible tab 1310 are pushed upwards by concave surface 1406 and into recess 1320. When top longitudinal insert 502 is completely inserted into channel 504, pad 1308 is aligned with passage 1300 and is pushed into passage 1300 by a force exerted by flexible tab 1310. In this position, pad 1308 presses against one end of top releasing insert 1002 within passage 1300, thereby forcing top releasing insert 1002 to a maximum, bottom position, i.e., one portion of releasing insert 1002 substantially flush, or even extending slightly past, back surface 1000 and/or reinforcement 1404.

Figure 19:
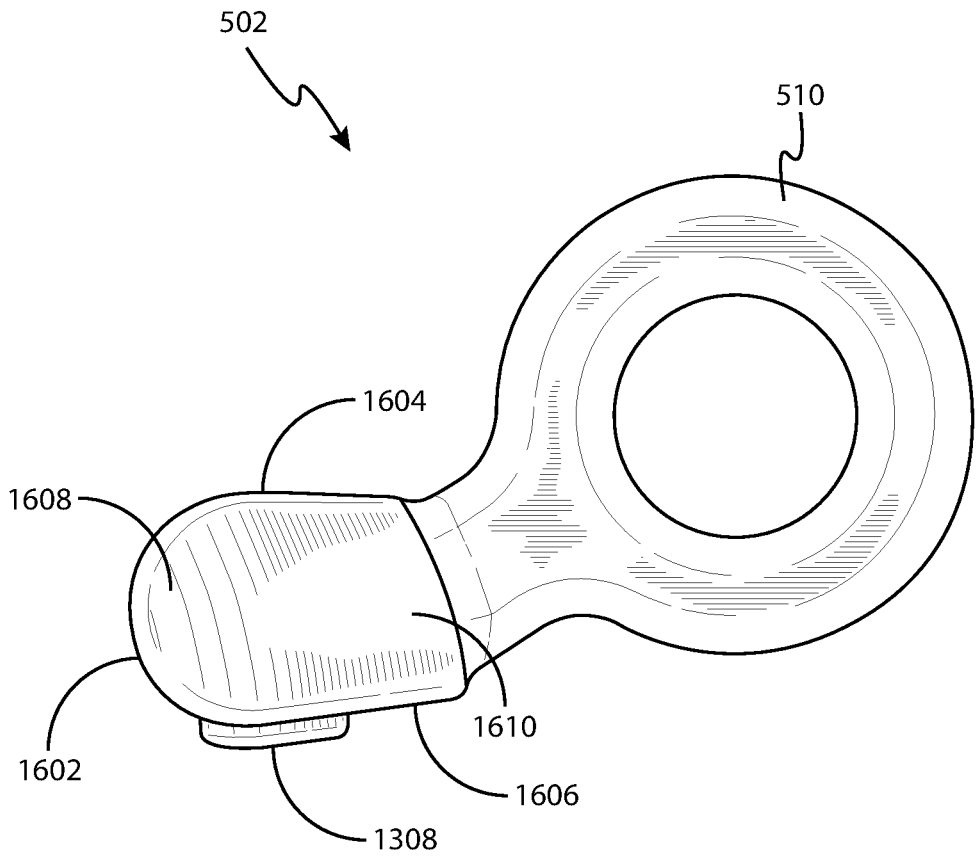
FIG. 19 is a right, plan view of the top longitudinal insert as shown in FIG. 16.

FIG. 19 is a right, plan view of top longitudinal insert 502, offering yet another view of top longitudinal insert 502. This view shows a gradual, curved transition from end 1608 to outer surface 1610, the curvature of surface 610 and another example of pad 1308 extending from bottom surface 1606. In this embodiment, tether 510 extends from top longitudinal insert 502 at an angle with respect to outer surface 1610 (as opposed to extending perpendicularly from outer surface 1610). The angle allows tether 510 to extend substantially perpendicularly from top portion 800 of housing 514 when top longitudinal insert 502 is inserted into channel 504. Otherwise, tether 510 would extend downwards and towards back surface 1000, making device 100 awkward for a user to wear, as device 100 would hang at an angle from a lanyard around a user's neck.

Figure 20A:
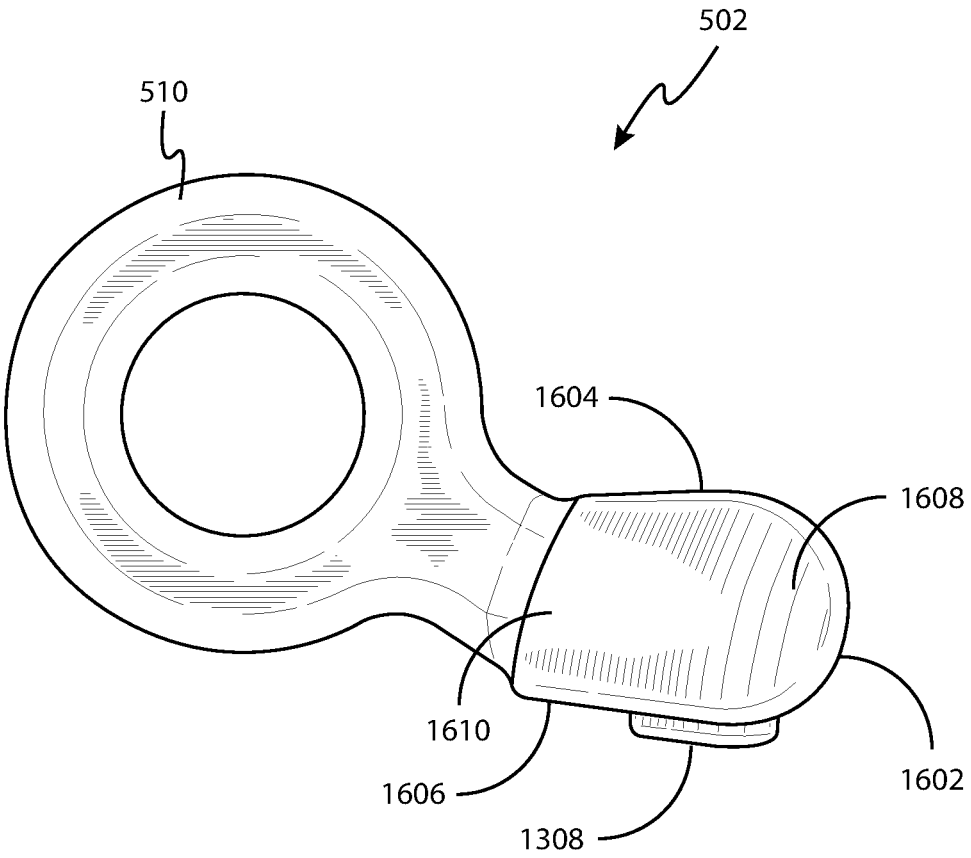
FIG. 20A is a left, plan view of the top longitudinal insert as shown in FIG. 16.

FIG. 20A is a left, plan view of top longitudinal insert 502, illustrating an opposing view of the one shown in FIG. 19.

Figure 20B:
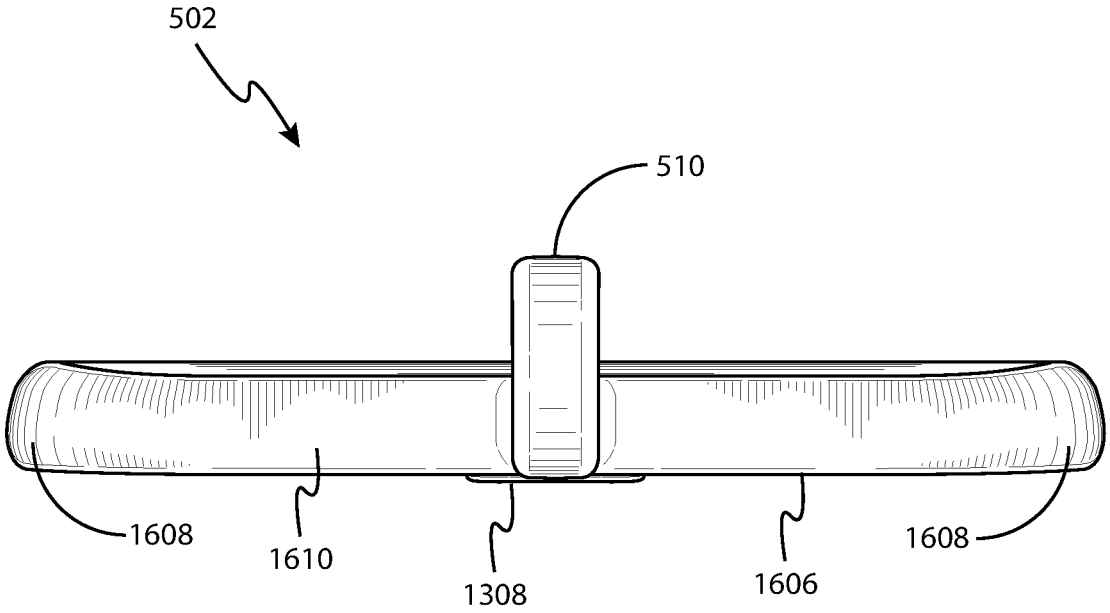
FIG. 20B is a top, plan view of the top longitudinal insert as shown in FIG. 16.

FIG. 20B a is a top, plan view of top longitudinal insert 502, illustrating how pad 1308 extends from bottom surface 1606 of top longitudinal insert 502. Also shown in this view is how ends 1608 are curved to conform to a curved surface of top portion 800 of housing 514 when top longitudinal insert 502 is fully inserted into channel 504.

Figure 21:
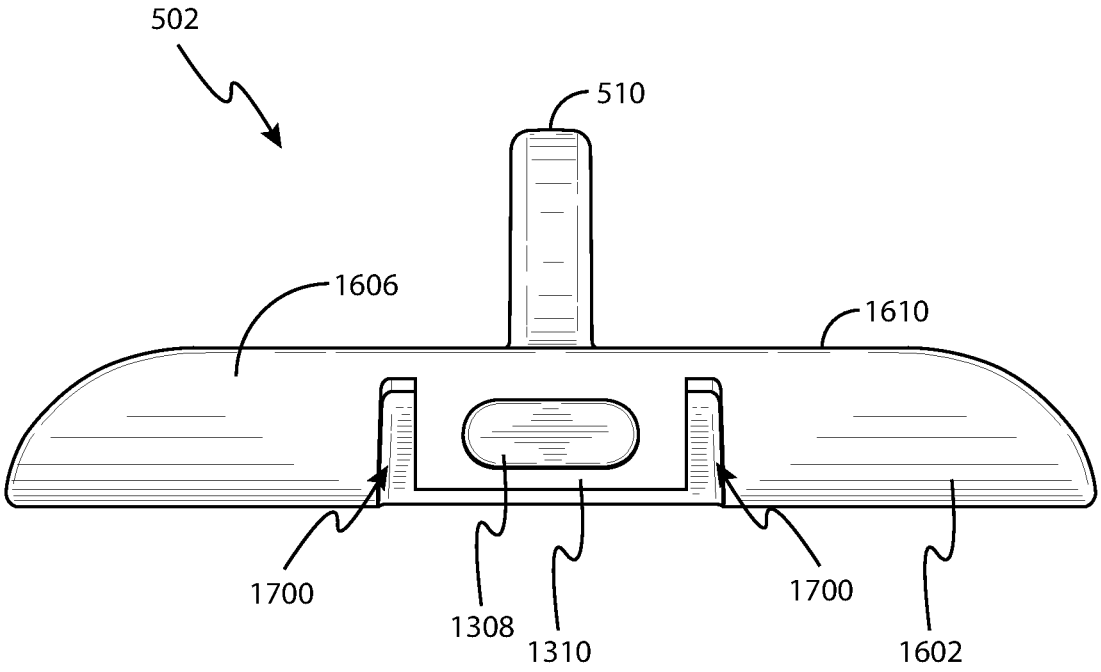
FIG. 21 is a bottom, plan view of the top longitudinal insert as shown in FIG. 16.

FIG. 21 is a bottom, plan view of top longitudinal insert 502. Clearly shown is tether 510, pad 1308, flexible tab 1310, notches 1700, outer surface 1610, and bottom surface 1606. Pad 1308 is shown in this view as a "flattened" oval, although in other embodiments, pad 1308 may comprise a different shape, such as a circle, rectangle, square, etc.

Figure 22:
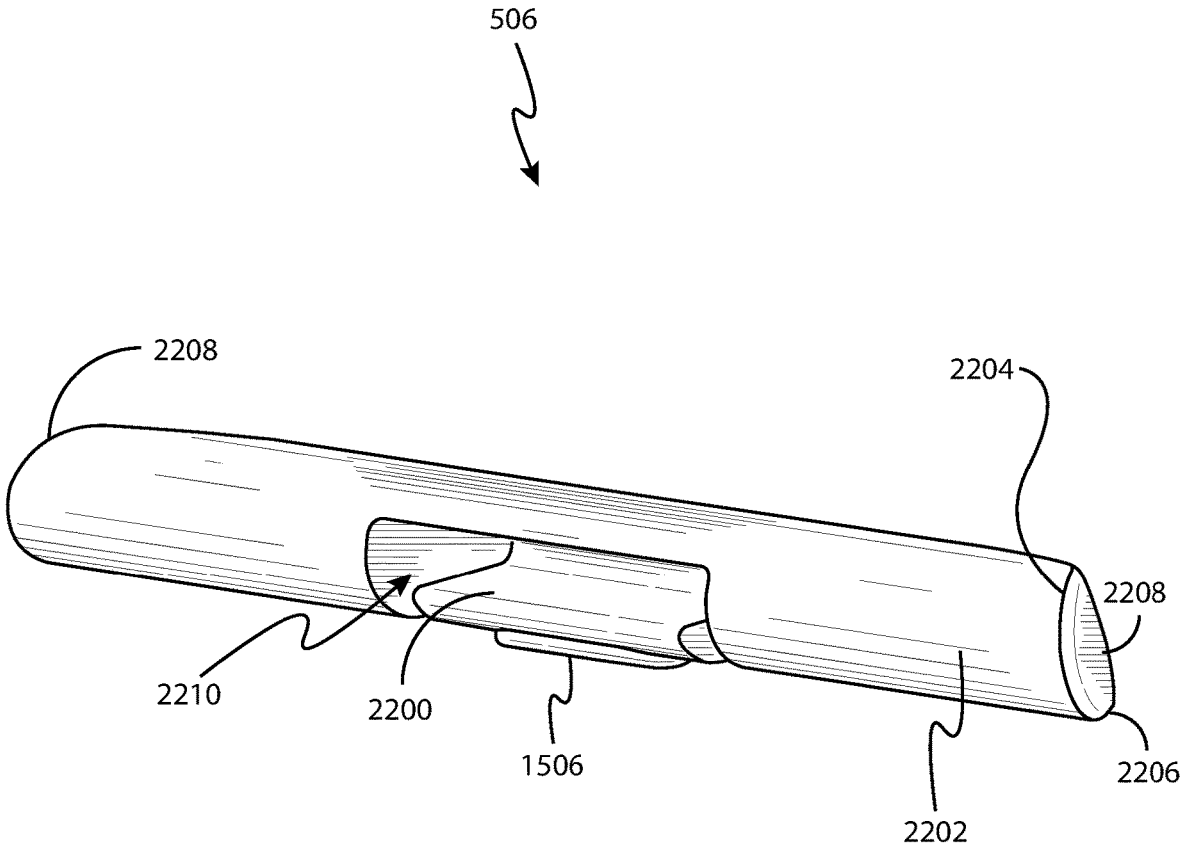
FIG. 22 is a perspective view of a bottom longitudinal insert of the wearable, configurable, personal electronic device shown in FIG. 5.

FIG. 22 is a perspective view of bottom longitudinal insert 506. In one embodiment, bottom longitudinal insert 506 is identical to top longitudinal insert 502, with the exception that bottom longitudinal insert 506 lacks a tether similar to tether 510. In other embodiments, bottom longitudinal insert 506 may differ from top longitudinal insert 502 in its shape and/or dimensions.

In the embodiment shown in FIG. 22, the features of bottom longitudinal insert 506 are the same or similar to the features of top longitudinal insert 502. Bottom longitudinal insert 506 comprises pad 1506 (corresponding to pad 1308 of top longitudinal insert 502), flexible tab 2200 (corresponding to flexible tab 1310 of top longitudinal insert 502), convex surface 2202 (corresponding to inner surface 1602 of top longitudinal insert five or two), which abuts concave surface 1408 of bottom channel 508 when bottom longitudinal insert 506 is inserted into bottom channel 508, top surface 2204 (corresponding to top surface 1604 of top longitudinal insert 502), bottom surface 2206 (corresponding to bottom surface 1606 of top longitudinal insert 502), two ends 2208 (corresponding to ends 1608 of top longitudinal insert 502), and a recess 2210 (corresponding to recess 1320 of top longitudinal insert 502). Bottom longitudinal insert 506 is inserted into bottom channel 508 in the same way that top longitudinal insert 502 is inserted into top channel 504: one end 2208 is inserted into one end of bottom channel 508, and then pad 1506 is pushed so that it is flush with convex surface 2202 and bottom surface 2206, allowing bottom longitudinal insert 506 to be pushed further into bottom channel 508. As bottom longitudinal insert 506 is placed into the fully-inserted position, with both ends 2208 flush with a respective side of housing 514, pad 1506 is forced into recess 2210 by a spring force of flexible tab 2200, thereby locking bottom longitudinal insert 506 in place.

In one embodiment, where housing 514 comprises top channel 504 and bottom channel 506, typically both top longitudinal insert 502 and bottom longitudinal insert 506 are inserted into top channel 504 and bottom channel 508, respectively, in order to give device 100 a smooth and desirable appearance. Housing 514, in one embodiment, does not comprise bottom channel 508 or bottom longitudinal insert 506 but, rather, bottom portion 512 of housing 514 comprises an un-interrupted surface and may comprise rounded corners and surfaces in order to be aesthetically pleasing. However, in this embodiment, device 100 cannot generally be worn around a user's wrist using a standard, widely available wristband, because use of device 100 with a standard wristband typically requires two points of contact with housing 514 by each end of the wristband, respectively.

Figure 23:
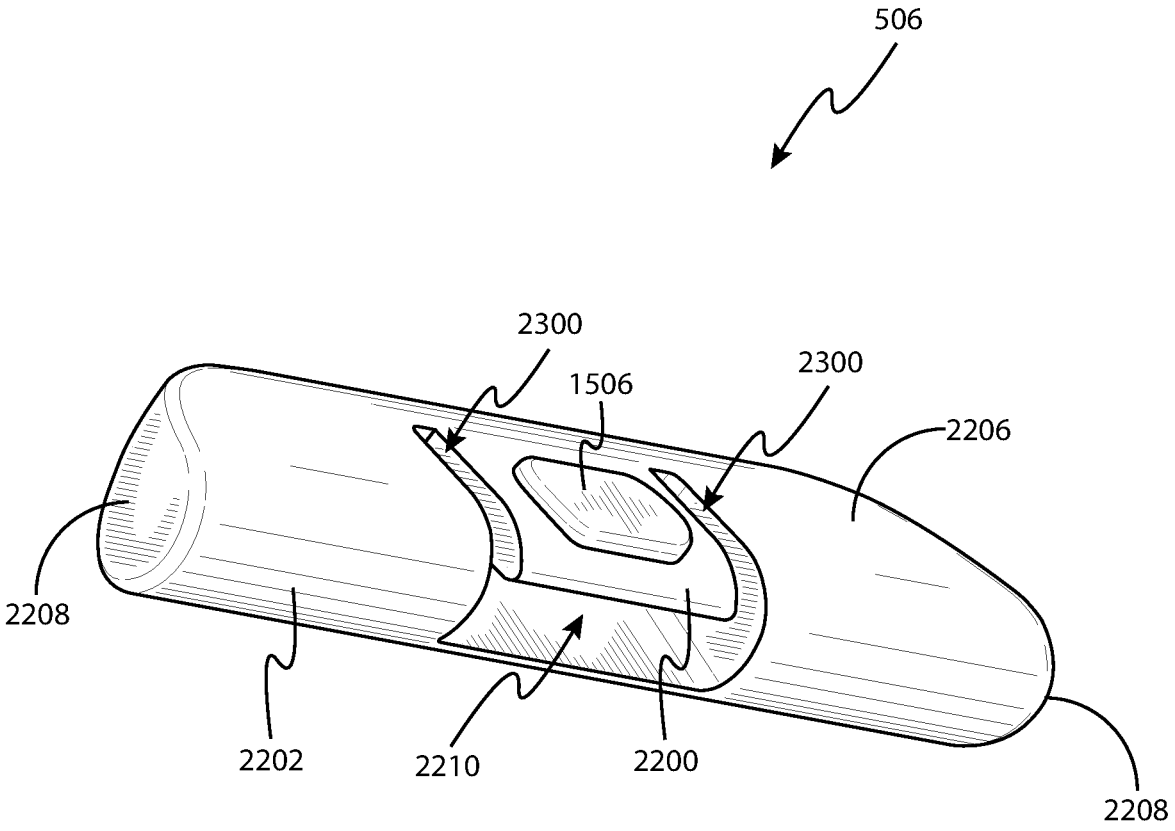
FIG. 23 is an inverted, perspective view of the bottom longitudinal insert as shown in FIG. 22.

FIG. 23 is an inverted, perspective view of bottom longitudinal insert 506, showing the same components as shown in FIG. 22, more clearly showing bottom surface 2206 and flexible tab 2200 formed from two notches 2300 formed in bottom surface 2206 and convex surface 2202, similar to notches 1700 of top longitudinal insert 502.

Figure 24:
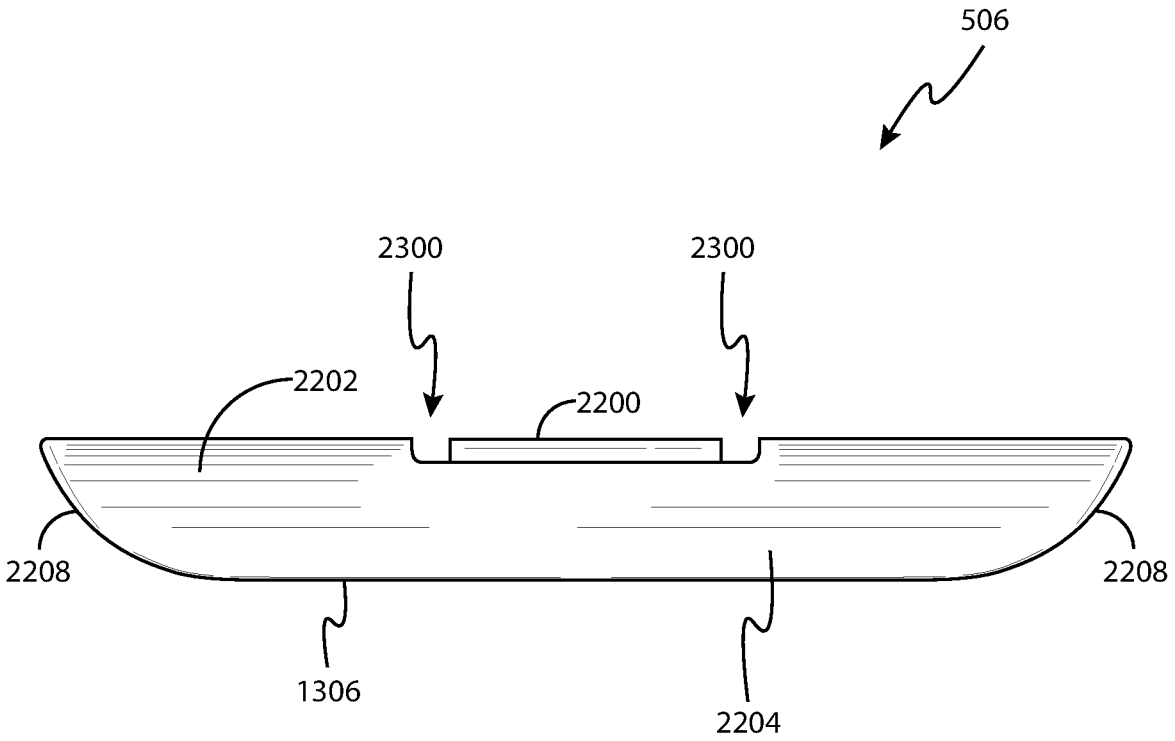
FIG. 24 is a front, plan view of the bottom longitudinal as shown in FIG. 22.

FIG. 24 is a front, plan view of bottom longitudinal insert 506, showing many of the components already shown and discussed in FIGS. 22 and 23. Of note in this figure is the smooth, rounded surface of ends 2208, formed to match bottom portion 512 of housing 514 when bottom longitudinal insert 506 is inserted into bottom channel 508.

Figure 25:
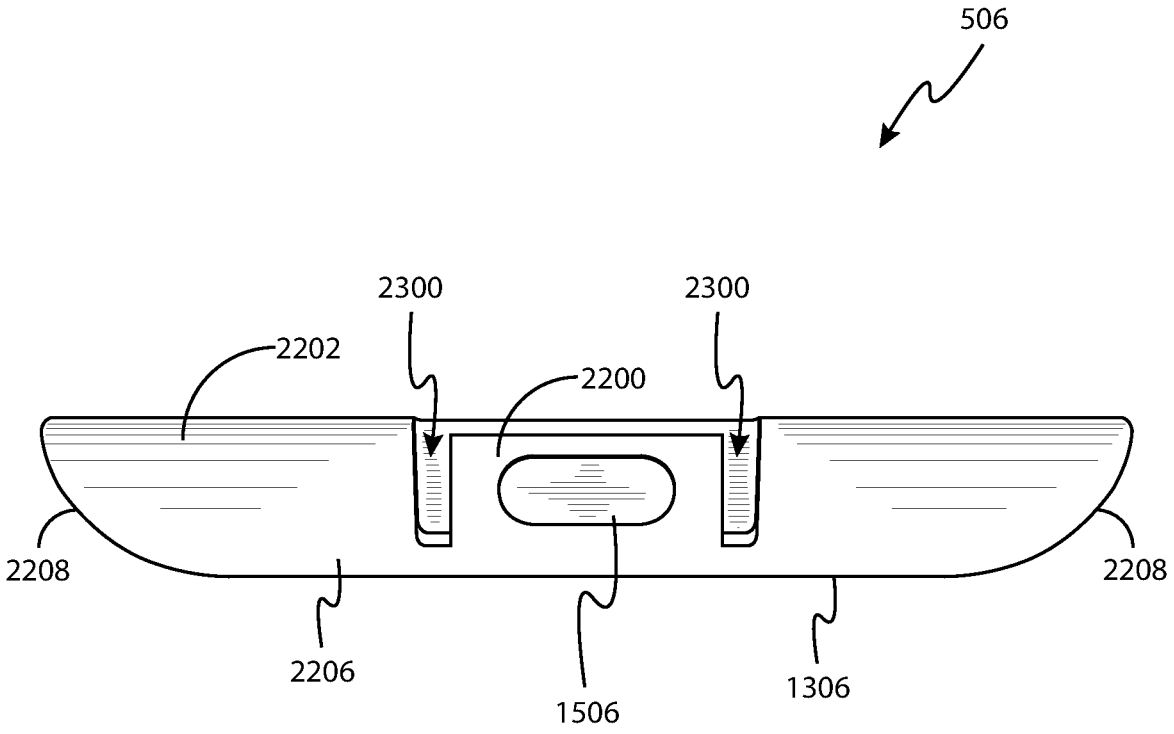
FIG. 25 is a back, plan view of the bottom longitudinal insert shown in FIG. 22.

FIG. 25 is a back, plan view of bottom longitudinal insert 506, again showing many of the components already shown and discussed in FIGS. 22 through 23. Prominently shown are the two notches 2300 that form flexible tab 2200, as well as bottom surface 2206 and convex surface 2202.

Figure 26:
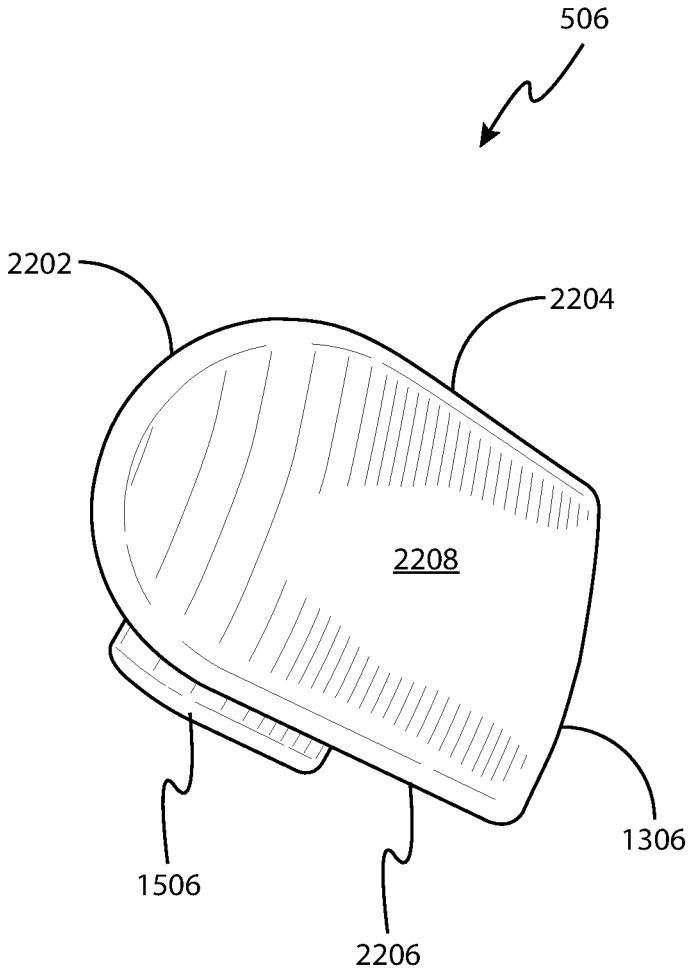
FIG. 26 is a left, plan view of the bottom longitudinal insert shown in FIG. 22.

FIG. 26 is a left, plan view of bottom longitudinal insert 506. Shown is end 2208 with a rounded surface in conformity with a left side of top portion 800, such that when bottom longitudinal insert 506 is inserted into channel 508, a left side of top portion 800 is substantially flush with end 2208.

Pad 1506 is shown protruding from bottom surface 2206 in this view. Convex surface 2202 is sized and shaped in conformity with concave surface 1408 of channel 508, such that bottom longitudinal insert 506 fits snugly within bottom channel 508 of housing 514. Also shown in this view is top surface 2204, which is flat in this embodiment, as well as outer convex surface 1306, which is slightly curved, again to comport to top portion 800 of housing 514.

Figure 27:
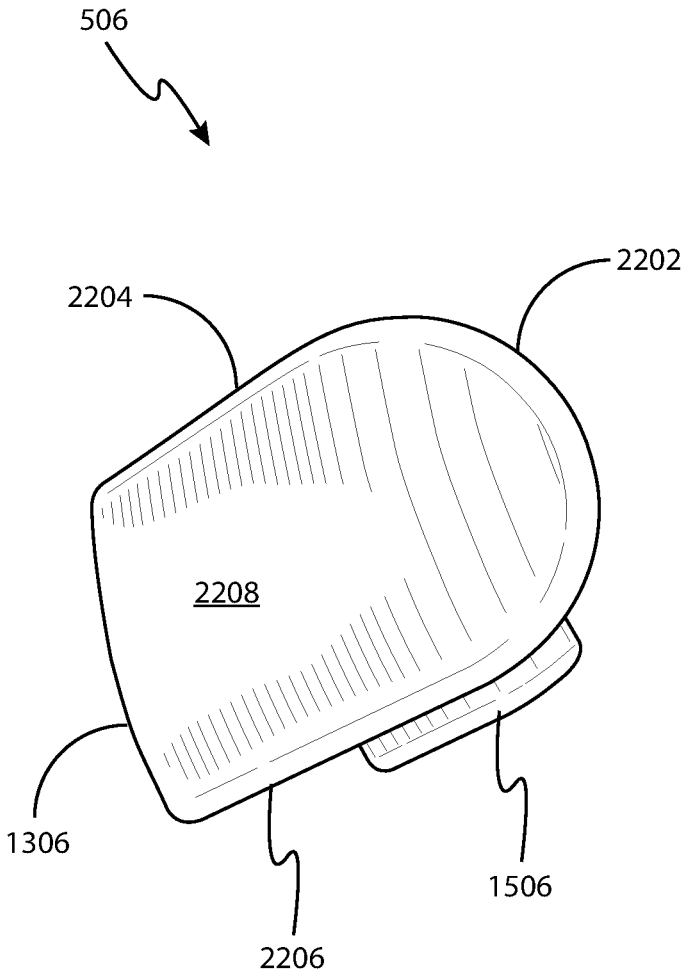
FIG. 27 is a right, plan view of the bottom longitudinal insert shown in FIG. 22.

FIG. 27 is a right, plan view of bottom longitudinal insert 506, showing an opposing side view of bottom longitudinal insert 506 then the view shown in FIG. 26.

Figure 28:
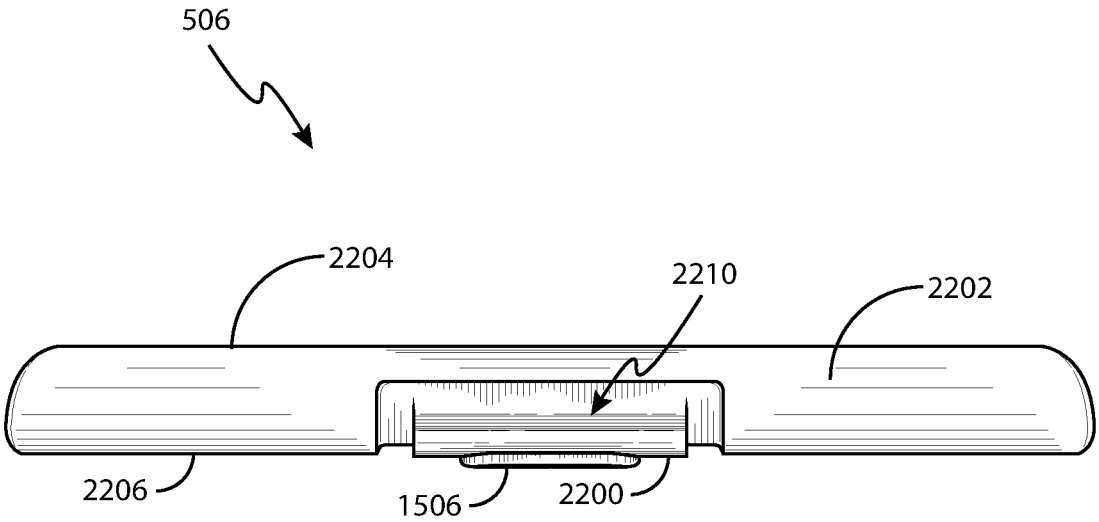
FIG. 28 is a top, plan view of the bottom longitudinal insert shown in FIG. 22.

FIG. 28 is a top, plan view of bottom longitudinal insert 506, i.e., looking through device 100 from a top view, i.e., through top longitudinal insert 502 and through device 100. In this view, recess 2210 can be clearly seen. Pad 1506 clearly extends past bottom surface 2206 when bottom longitudinal insert 506 is inserted fully into bottom channel 508, or when bottom longitudinal insert 506 is not installed into channel 508. Flexible tab 2200 is shown flush with bottom surface 2206 and convex surface 2202. When inserting bottom longitudinal insert 506 into channel 508, pad 1506 and flexible tab 2200 are pushed upwards by concave surface 1408 and into recess 2210. When bottom longitudinal insert 506 is completely inserted into channel 508, pad 1506, via flexible tab 2200, is restored to the position as shown in FIG. 28, and pad 1506 presses against one end of bottom releasing insert 1004 within passage 1408.

Figure 29:
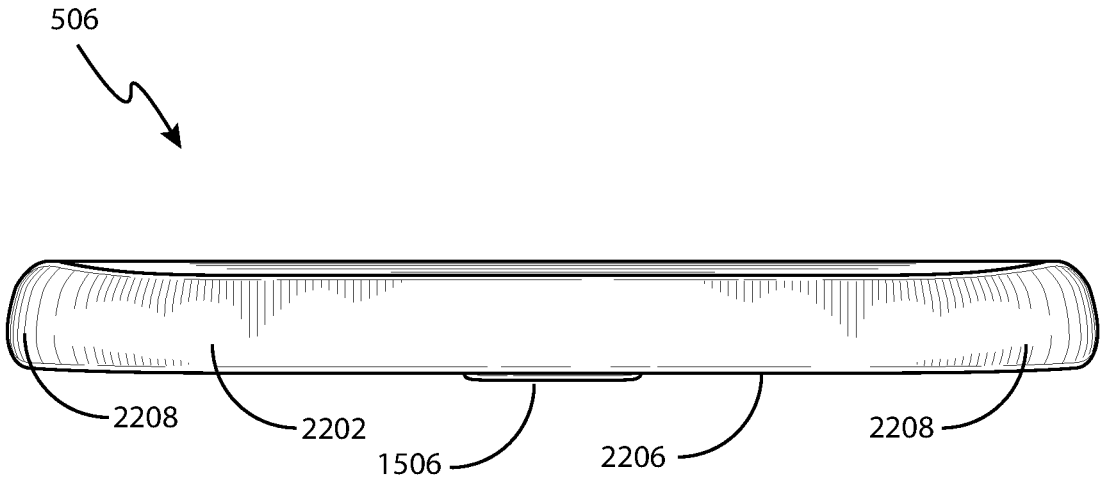
FIG. 29 is a bottom, plan view of the bottom longitudinal insert shown in FIG. 22.

FIG. 29 is a bottom, plan view of bottom longitudinal insert 504, illustrating how pad 1506 extends from bottom surface 2206 of bottom longitudinal insert 506. Also shown in this view is how ends 2208 are curved to conform to bottom portion 512 of housing 514 when bottom longitudinal insert 502 is fully inserted into channel 506.

When a user wishes to where device 100 around the user's neck, rather than clipped to the users felt, pants, table, desk, etc., the user inserts a lanyard (not shown) through tether 510 of top longitudinal insert 502 and places the lanyard over the user's head. Typically, longitudinal insert 506 is secured into channel 508 in order to give device 100 a smooth, aesthetically-pleasing appearance.

Figure 30:
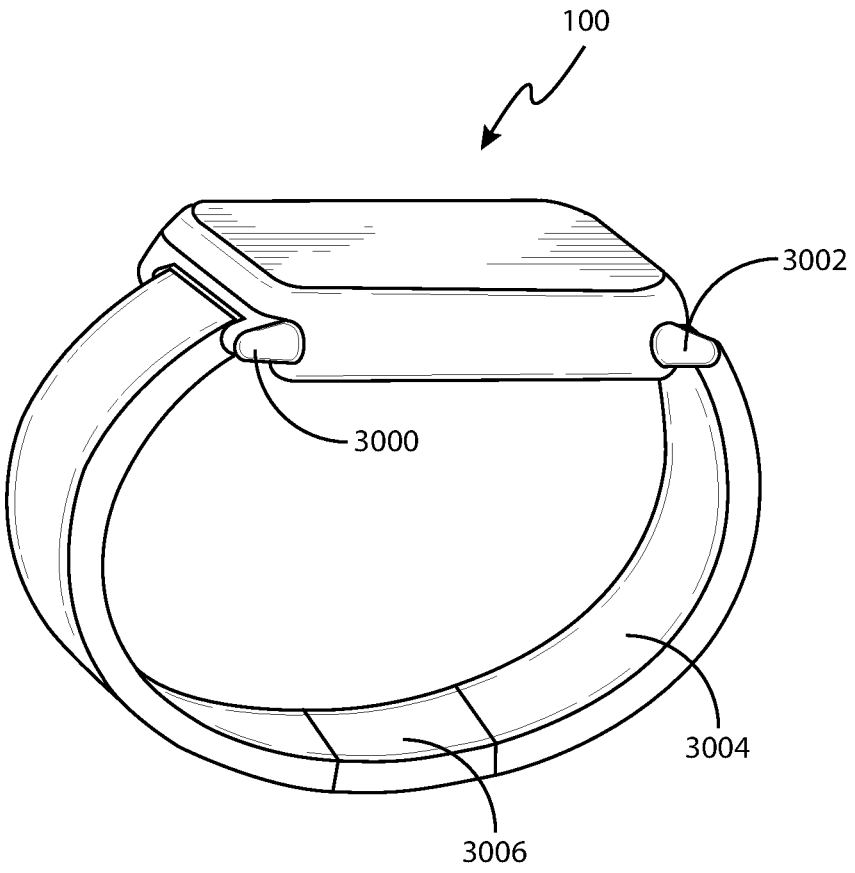
FIG. 30 is a perspective view of the device as shown of either FIG. 5A or 5C, worn on a user's wrist.

FIG. 30 is a perspective view of device 100, configured for wear around a user's wrist. In this embodiment, device 100 is configured by removing its respective top and bottom longitudinal inserts, leaving its top channel and bottom channel exposed, and then inserting top and bottom longitudinal inserts 3000 and 3002 of wristband 3004 into the top and bottom channels, respectively. Each of longitudinal inserts 3000 and 3002 are the same or similar to bottom longitudinal insert 506, as shown and described herein throughout, comprising the same or similar flexible tab, pad and recess for allowing each longitudinal insert to slide within a respective channel of housing 514, and lock into place when a respective pad of each flexible tab of each longitudinal insert is forced into a respective passage formed into each of the channels. Each of the longitudinal inserts 3000 and 3002 are configured to receive a portion of wristband 3004 as a point of connection between wristband 3004 and each of the longitudinal inserts 3000 and 3002. To remove the wristband from housing 514, a respective releasing insert, the same or similar to releasing inserts 1302 and 1304, as shown in at least FIG. 15, located each in a respective passage, is pushed downwards from a backside of device 100 by a user, and the releasing inserts force each of the pads into a respective recess of each respective longitudinal insert, thereby eliminating mechanical interference between the each respective pad and channel thus allowing each of the longitudinal inserts of wristband 3004 to slide out of each respective channel of housing 514. Typically, wristband 3004 comprises a clasp, buckle or some other mechanical means 3006 to open wristband 3004 in order for a user to place the wristband around a user's wrist.

Figure 31:
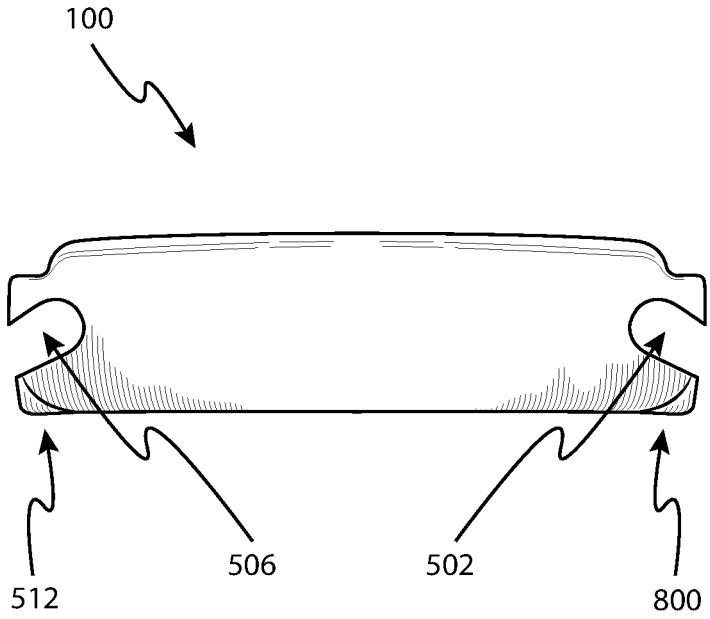
FIG. 31 is a perspective view of the wristband as shown in FIG. 30.

FIG. 31 is a perspective view of device 100 as used in this embodiment, highlighting each of the channels 502 and 506 formed into a respective top portion 800 and bottom portion 512, respectively, of housing 514, as shown and described elsewhere herein. This view is similar to the view shown in FIG. 15.

Figure 32:
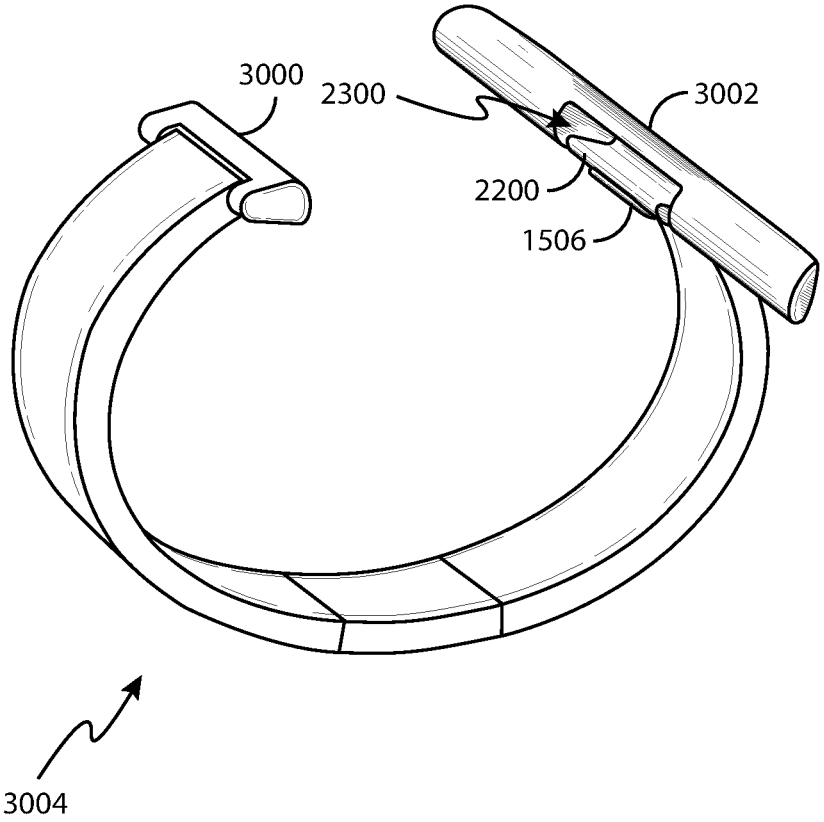
FIG. 32 is a perspective view of the wristband as shown in FIG. 30.

FIG. 32 is a perspective view of the wristband as shown in FIG. 30. This view shows in particular the features of longitudinal insert 3002 as having the same or similar features as bottom longitudinal insert 506. Shown is pad 1506, flexible tab 2200 and recess 2300. Longitudinal insert 3000 comprises the same or similar components as longitudinal insert 3002.

Naturally, all examples discussed herein are merely illustrative and should not be construed to limit the scope of the inventive technology consistent with the broader inventive principles disclosed. As may be easily understood from the foregoing, the basic concepts of the present inventive technology may be embodied in a variety of ways. In addition, while some devices are disclosed, it should be understood that these not only accomplish certain methods but also can be varied in a number of ways. Importantly, as to all of the foregoing, all of these facets should be understood to be encompassed by this disclosure.

It should also be understood that a variety of changes to the inventive concepts discussed herein may be made without departing from the essence of the inventive technology. Such changes are also implicitly included in the description. They still fall within the scope of this inventive technology. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the inventive technology both independently and as an overall system.

Further, each of the various elements of the inventive technology and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the inventive technology, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this inventive technology is entitled. As but one example, it should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

Any priority case(s) claimed by this application is hereby appended and hereby incorporated herein by reference in its entirety. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated herein by reference in their entirety.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in Hakim v. Cannon Avent Group, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 715 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the inventive technology, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

I claim:

1. A device, comprising:

a housing;

a channel formed through a portion of the housing extending from a first side of the housing to an opposing second side of the housing;

a longitudinal insert having a cross-section substantially matching a cross-section of the channel for insertion into and removal from the channel;

a passage formed through the housing, the passage connecting a space inside the channel through to a surface of the housing; and a releasing insert movably secured within the passage, the releasing insert for releasing the longitudinal insert from the channel when it is desired to remove the longitudinal insert from the housing;

wherein the longitudinal insert comprises a recess, a flexible tab positioned over the recess, and a pad mounted on the flexible tab extending in a direction away from the recess configured to be forced into the passage and against the releasing insert when the longitudinal insert is fully inserted into the channel.

2. The device of claim 1, wherein the flexible tab is substantially flush with one or more surfaces of the longitudinal insert and the pad extends past the at least one portion of the surface of the longitudinal insert when the longitudinal insert is in a quiescent position.

3. The device of claim 2, wherein the one or more surfaces of the longitudinal insert comprises a convex surface and a flat surface.

* * * * *